US006302832B1

(12) United States Patent
Stearns

(10) Patent No.: US 6,302,832 B1
(45) **Date of Patent: *Oct. 16, 2001**

(54) EXERCISE DEVICE

(76) Inventor: Kenneth W. Stearns, P.O. Box 55912, Houston, TX (US) 77255

( * ) Notice: Subject to any disclaimer, the term of this patent is extended or adjusted under 35 U.S.C. 154(b) by 0 days.

This patent is subject to a terminal disclaimer.

(21) Appl. No.: 09/454,739

(22) Filed: Dec. 6, 1999

Related U.S. Application Data

(63) Continuation of application No. 08/883,140, filed on Jun. 27, 1997, now Pat. No. 5,997,446, which is a continuation-in-part of application No. 08/526,892, filed on Sep. 12, 1995.

(51) Int. Cl.[7] ..... A63B 21/02
(52) U.S. Cl. ..... 482/96; 482/95; 482/72
(58) Field of Search ..... 482/94, 95, 72, 482/57, 206, 110, 111

(56) References Cited

U.S. PATENT DOCUMENTS

| | | |
|---|---|---|
| D. 218,624 | 9/1970 | Margolles . |
| 2,107,447 | 2/1938 | Marlowe . |
| 2,145,940 | 2/1939 | Marlowe . |
| 2,470,544 | 5/1949 | Bell . |
| 2,642,288 | 6/1953 | Bell . |
| 2,825,563 | 3/1958 | Lawton . |
| 2,924,456 | 2/1960 | Miller . |
| 3,134,378 | 5/1964 | Harwood . |
| 3,380,737 | 4/1968 | Elia . |
| 3,446,503 | 5/1969 | Lawton . |
| 4,248,420 | 2/1981 | Hayes . |
| 4,257,590 | 3/1981 | Sullivan . |
| 4,300,760 | 11/1981 | Bobroff . |
| 4,336,934 | 6/1982 | Hannagan . |
| 4,353,547 | 10/1982 | Jenkinson . |
| 4,452,448 | 6/1984 | Ausherman . |
| 4,542,899 | 9/1985 | Hendricks . |

(List continued on next page.)

FOREIGN PATENT DOCUMENTS 2 619 017 2/1989 (FR) .

OTHER PUBLICATIONS

CSA, E–Force Cross Trainer, Model T1200.
Roadmaster Corporation, Iron Horse Club #R–8030T.
Roadmaster Corporation, Iron Horse Club #R–8027T.
Roadmaster Corporation, Iron Horse Club #R–8023T.
American Sports, Cardio–Rider.
Weslo, Inc., CardioGlide.
Aeroflex, Complete Fitness System.

* cited by examiner

*Primary Examiner*—Jerome Donnelly

(57) ABSTRACT

An exercise device (10) has a handlebar (30) with handgrips (32) for gripping by a user (U). An adjustment plate member (26) is mounted for pivotal movement about a pivot (28) on a fixed support plate member (18). A seat (58) supports the weight of the user U to resist to the rotation of the adjustment plate (26). A generally horizontal exercise movement is performed by pulling on the handlebar (30) and simultaneously pushing on foot pedals (70) on a foot frame (68) secured to the adjustment plate member (26). The horizontal exercise movement shown in FIGS. 1 and 2 can be easily converted to a vertical exercise movement shown in FIG. 3 at the discretion of the user (U) by changing the motion exerted against the handlebar (30) by the user (U). An adjustment lever (100) may be adjusted along adjustment plate (26) to vary the force exerted by the weight of the user (U) on seat (58) against adjustment plate member (26) through a force applying link (63), pivot (112), inner adjustment levers (110), and shaft (106) carried by the adjustment plate member (26). The adjustment lever (100) also is used to convert the device from pulling type exercises to pushing type exercises and vice versa.

11 Claims, 24 Drawing Sheets

U.S. PATENT DOCUMENTS

| | | | |
|---|---|---|---|
| 4,586,706 | 5/1986 | Chen . | |
| 4,603,855 | 8/1986 | Sebelle . | |
| 4,616,825 | 10/1986 | Anderson . | |
| 4,629,185 | 12/1986 | Amann . | |
| 4,641,833 | 2/1987 | Trethewey . | |
| 4,645,200 | 2/1987 | Hix . | |
| 4,657,244 | 4/1987 | Ross . | |
| 4,721,303 | 1/1988 | Fitzpatrick . | |
| 4,728,099 | 3/1988 | Pitre . | |
| 4,743,010 | 5/1988 | Geraci . | |
| 4,798,378 | 1/1989 | Jones . | |
| 4,817,943 | 4/1989 | Pipasik . | |
| 4,850,587 | 7/1989 | Lin . | |
| 4,943,051 | 7/1990 | Haskins . | |
| 4,949,951 | 8/1990 | Deola . | |
| 4,949,954 | 8/1990 | Hix . | |
| 4,986,538 | 1/1991 | Ish, III . | |
| 5,072,929 | 12/1991 | Peterson . | |
| 5,156,650 | 10/1992 | Bals . | |
| 5,178,599 | 1/1993 | Scott . | |
| 5,342,269 | 8/1994 | Huang et al. . | |
| 5,527,243 | 6/1996 | Chen . | |
| 5,573,482 * | 11/1996 | Wang et al. | 482/96 |
| 5,722,918 | 3/1998 | Lee . | |

* cited by examiner 845
846
848
849
840
804
847

800
225
220
262
210
221
260
241
244
231
263
836
835
242
847
253
837
803
830
250
254

839
838

EXERCISE DEVICE

CROSS REFERENCE TO RELATED APPLICATION

This application is a continuation of U.S. patent application Ser. No. 08/883,140, filed on Jun. 27, 1997, now U.S. Pat. No. 5,997,946 which in turn, is a Continuation-In-Part of pending application Ser. No. 08/526,892 filed on Sep. 12, 1995

BACKGROUND OF THE INVENTION

1. Field of the Invention

This invention relates to an exercise device. In particular, it relates to an exercise device of the type permitting the user to selectively perform multiple exercise movements. Still more particularly, the invention relates to an exercise device which (1) simulates a horizontal pulling or rowing type exercise or alternatively a horizontal pushing or pressing forward type exercise; (2) simulates a vertical pull down type exercise or alternatively a vertically pressing upward type exercise and (3) allows motions intermediate horizontal or vertical type directions, either in a pressing mode or a pulling mode.

2. Description of the Prior Art

Heretofore, exercise devices or machines have been provided in which a user sits on a seat while pushing foot pedals and pulling on handgrip members at the same time. Examples of such devices are shown in U.S. Pat. Nos. 2,642,288 to J. D. Bell, U.S. Pat. No. 2,924,456 to H. J. Miller, and U.S. Pat. No. 4,300,760 to Bobroff. Resistance to the exercise movement of pushing against leg actuated foot pedals and/or pulling on arm actuated handlebars is provided by the weight of the user on the seat. The seat with the user thereon is raised by the user pulling on the arm actuated means and pushing on the leg actuated means simultaneously in an exercise movement. Weight of the user resists upward movement of the seat. These patents permit only a single rowing type exercise movement in a horizontal direction, but they do not provide a mechanism for a horizontal pressing forward type exercise movement or vertical pull down or pressing up type exercise movement at the discretion of the user. Also, no adjustment means is provided to vary the force exerted by the weight of the user against the leg actuated foot pedals and the arm actuated handlebars.

A machine sold under the trademark Cardioglide shows a similar type horizontal pulling exercise device in which the force resistance means is a hydraulic cylinder that restricts the movement of the seal. The hydraulic resistance is adjustable by rotation of a knob, which, in turn, adjusts to the size of a fluid orifice in the cylinder.

A machine sold under the trademark CSA-E-Force has an alternative handlebar position in which a user can perform an upper body horizontal pushing action, but the user must remove and then reinsert the handlebar in the alternative position. The device allows only horizontal movement and has no resistance adjustment.

Several exercise gym machines allow upper body movement in multiple directions. Examples of such machines are U.S. Patent Nos. 4,542,899 to Hendricks, U.S. Pat. No. 4,629,185 to Amann, U.S. Pat. No. 4,728,099 to Pitre, U.S. Pat. No. 4,949,951 to Deola, U.S. Pat. No. 4,986,538 to Ish, and U.S. Pat. No. 4,353,547 to Jenkenson. Such multi-direction exercise machines are either very complex and expensive or are very limited in their motions. Also, none provide any means for allowing coordinated movements of the upper body with the lower body.

There is a need for an exercise machine that allows a wide variety of movements yet is simple and inexpensive to produce and further provides other features described as follows.

3. Identification of Objects of the Invention

In view of the limitations of the prior art machines;

A primary object of the invention is to provide an exercise machine that allows a wide variety of exercise movements, yet is simple and inexpensive to produce.

Another object of the invention is to provide a machine as above that takes up very little floor space.

Another object of the invention is to provide a machine as above for allowing coordinated movement of a variety of upper body movements with simultaneous lower body exercise.

Another object of the invention is to provide a machine as above in which resistance to the various exercise movements is derived at least in part from the bodyweight of the user.

Another object of the invention is to provide a machine as above in which the machine may easily be converted from a pull type machine to a press type machine.

Yet another object of the invention is to provide a machine in which alternative horizontal only or vertical only exercise movements are allowed with selection of such movements by the user merely by changing the direction of force of the upper limbs while exercising.

Still another object of the invention is to provide a machine as above in which upper body exercise may be at any direction from horizontal to vertical with selection of such movements by the user merely by changing the direction of force of upper limbs while exercising.

SUMMARY OF THE INVENTION

The objects identified above, as well as other features are realized in the invention of an exercise device in which a user seated on a seat may grip a handlebar and selectively perform a generally vertical pull down type exercise movement or a generally horizontal rowing or pulling exercise movement while seated on the seat. The same handlebar in utilized for both exercise movements. The exercise movements may be changed by the user by changing the force exerted by the arms of the user against the handlebar without any additional adjustments being required. A linkage for the handlebar is pivotally connected between a support frame and an adjustment plate which is pivotally connected to the support frame. The device may be converted to a machine for press up vertical movements or push out horizontal exercise movements.

A seat is provided on a seat frame which is pivotally connected to the support frame. A link is pivotally connected between the seat frame and an adjustment plate for transferring a force proportional to the weight of the user on the seat against the adjustment plate tending to rotate the plate in a direction to provide resistance to the exercise movements of the handlebar. Foot pedals are linked to the adjustment plate such that the adjustment plate tends to rotate about is pivot point with respect to the frame when the user pushes forward on the pedals.

A rearward pulling exercise movement against the handlebar (or a downward pulling exercise movement) by the user is normally performed at the same time as a forward pushing exercise movement against the foot pedals by the feet of the seated user. The handlebar linkage transfers arm force to the adjustment plate tending to rotate it with respect to the frame when the handlebars are pulled horizontally, as in rowing type exercise, in the same direction of rotation caused by forward pushing of the foot pedals. The weight of the user on the seat, acting through an adjustable pivoted link to the adjustment plate, tends to rotate the adjustment plate in a opposite direction to that caused by the pulling handlebar movement and pushing foot pedal movement. Consequently, the user's weight provides resistance to the exercise movements. The seat is raised and lowered as a consequence of the exercise movements.

An adjustment lever carried by the adjustment plate may be manually adjusted in a series of positions on the adjustment plate for varying the resistance force applied by the weight of the user on the seat. A seat connecting link between the seat frame and the adjustment plate is coupled to the adjustment lever about a movable pivot point. Such pivot point is moved upon manual adjustment of the lever to change the point of application of force from the seat to the adjustment plate. The lever may also be adjusted so that the application of force from the seat connecting link reverses the direction of rotation of the adjustment plate caused by the user's weight, thereby converting the machine to a push up or press type exercise machine (and a horizontal push out machine), where the resistance of the user's weight opposes a pushing movement of the handlebar. Thus, a resistance force may be applied selectively against either a pulling exercise movement of the handlebar or a pushing exercise movement of the handlebar by manual adjustment of the adjustment lever.

When the adjustment lever is moved to a position which reverses the direction of rotation of the adjustment plate caused by the user's weight, vertical exercise movements are converted into a press up type of exercise movement of the handlebars. In either case, for vertical press up/horizontal push forward or vertical pull down/horizontal pull back (rowing) movements, the linkage between the handlebars and the adjustment plate allows exercise in a direction between horizontal and vertical. In other words, motions in any direction between horizontal and vertical are possible without any adjustment of the machine. All that is required is that the user change the angle of attack of the force of his arms and hands. By changing the position of the adjustment lever, the machine may be changed from a horizontal pull back/vertical pull down machine to a machine for horizontal push out/vertical press up or any angle between horizontal and vertical by change of user force to change angle of attack.

In order to restrict exercise movement to either a horizontal movement or a vertical movement, cam grooves are provided in a cam plate attached to an arm of the linkage mechanism which connects the handlebars to the adjustment plate. A cam follower carried by the adjustment plate is placed in the cam grooves of the cam plate. The grooves are designed and arranged such that when the cam follower is in a first groove, the linkage causes the handlebars to move between an extreme outward horizontal position and an extreme inward horizontal position. When the cam is in a second groove, the linkage causes the handlebars to move between an extreme upward vertical position and an extreme downward vertical position. The first and second grooves are connected such that the cam can move between the first and second grooves at the extreme inward horizontal position and the extreme downward vertical position. Accordingly, a user may convert the machine from a vertical pull down machine (or press up machine, depending on the position of the adjustment lever) by merely causing the handlebars to be pulled back to the extreme inner horizontal position or returned downward to the extreme lower vertical position and then changing the direction of the force exerted against the handlebars from horizontal to vertical or visa versa.

An important feature of this invention is in providing an exercise device having a handlebar, which may be selectively moved in a pull back rowing (or push forward) generally horizontal exercise movement, or in a pull down (or press up) general vertical exercise movement by manual gripping of the handlebar. If desired, a horizontal exercise movement may be combined with the vertical exercise movement by alternating horizontal and vertical movements. The only action required to change the exercise movement of the handlebar from a vertical movement to a horizontal movement, or vice versa, is for the user to change the direction of force exerted against the handlebar by the arms of the user.

Another important feature of the invention is a manually operated adjustment lever which may be actuated to apply the resistance of the user's bodyweight selectively against the pushing movement of the handlebar or to convert the machine to resist a pulling movement of the handlebar. Different muscles of the user are employed in a pulling movement as opposed to a pushing movement. Thus, it may be desirable to change the resistance acting against a pulling movement of the handlebar to a resistance acting against a pushing movement of the handlebar, or vice versa. The resistance is provided by the weight of a user seated on a seat applied against an adjustment plate operatively connected to the handlebar. The amount of resistance applied against handlebar movements, either pushing type or pulling type, may be varied by adjustment of the manually operated adjustment lever. The weight of the user on the seat is applied as a proportional force to the adjustment plate by a link coupled between the seat and the adjustment plate. Of course, other add-on resistance means can easily be added to the device.

Another feature of the invention includes foot pedals and an associated foot frame secured to the adjustment plate to allow the feet of the user to push (or to pull) against the foot pedals to assist in overcoming the resistance of the seated user to provide an exercise movement for the lower limbs or legs of the user.

Other advantages and features of the invention will become more apparent by reference to the drawings which are appended hereto and wherein like numerals indicate like elements and wherein an illustrative embodiment of the invention is shown.

BRIEF DESCRIPTION OF THE DRAWINGS

The objects, advantages, and features of the invention will become more apparent by reference to the drawings which are appended hereto and wherein like numerals indicate like parts and wherein an illustrative embodiment of the invention is shown, of which.

DESCRIPTION OF THE PREFERRED EMBODIMENT OF THE INVENTION

Figure 1:
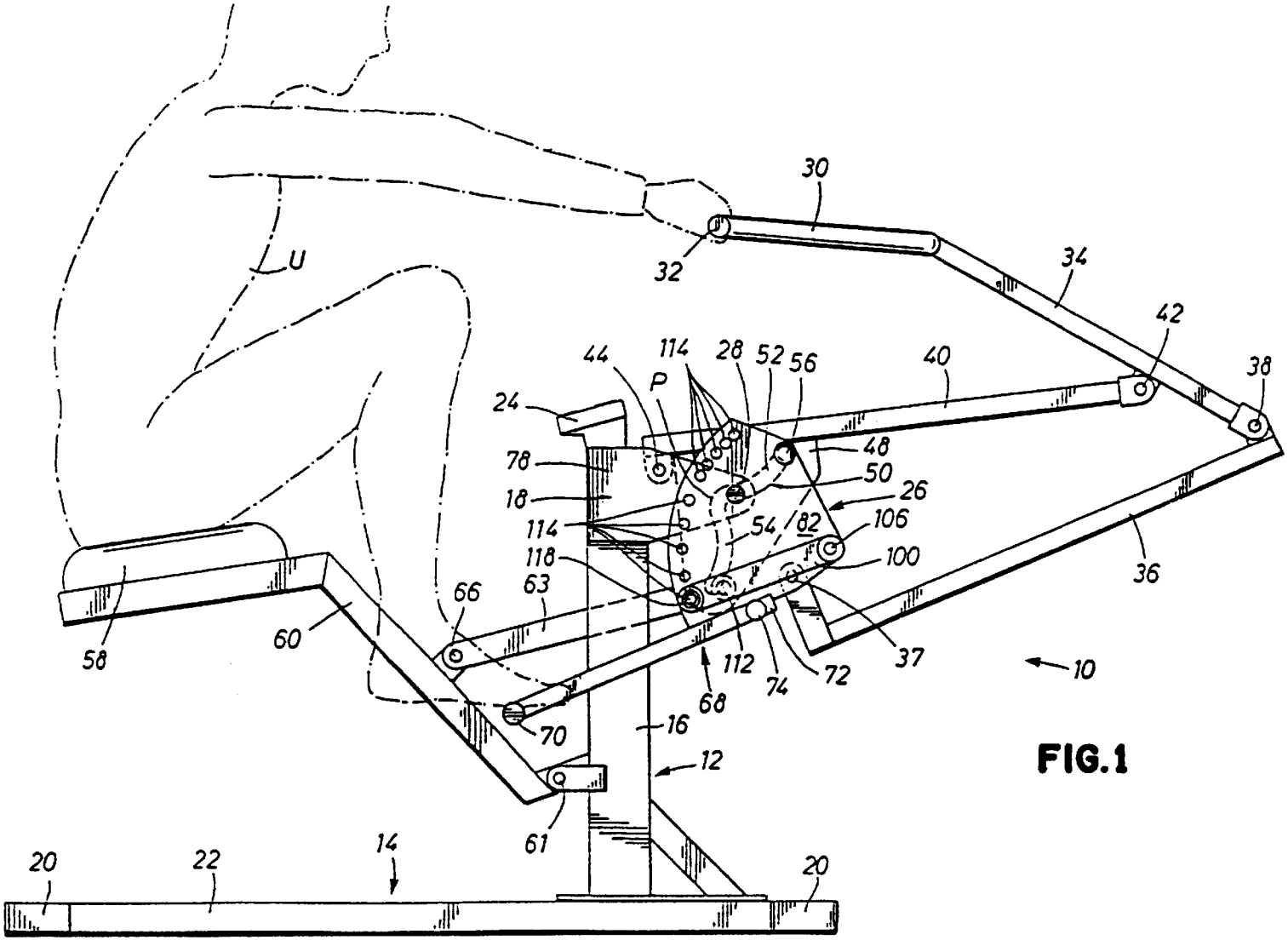
FIG. 1 is a side elevation of a preferred embodiment of the exercise device of this invention where the device includes a cam arrangement which restricts exerciser either to horizontal movement or to vertical movement and in which the device is configured for pulling exercises, the illustration showing a user seated on a lowered seat and gripping a handlebar in a front extended or forward reaching position for commencing a generally horizontal rowing type exercise movement by manually pulling back on the handlebar while simultaneously pushing forward on foot pedals, wherein the weight of the user on such seat resists the pulling movement.
Figure 2:
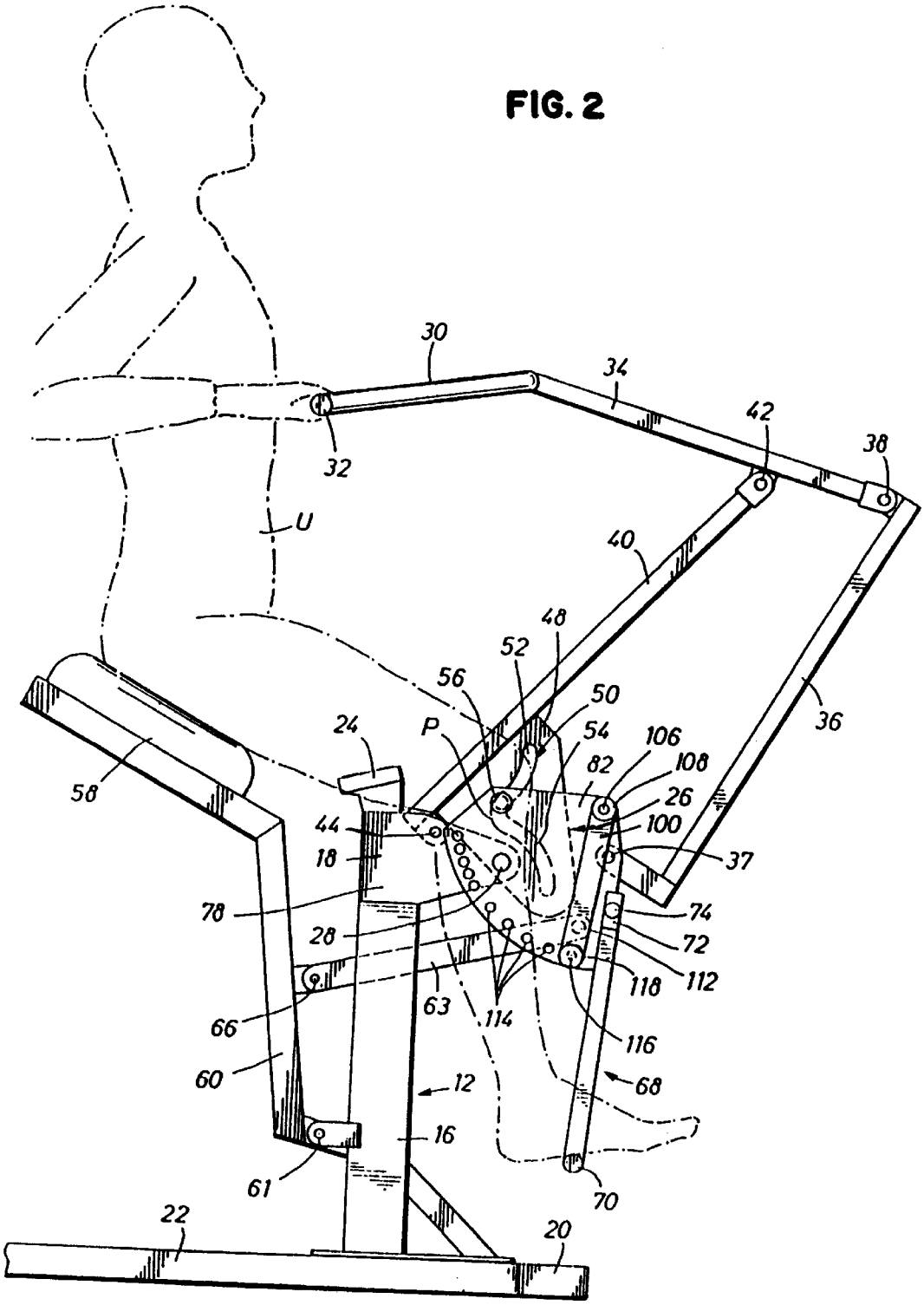
FIG. 2 is a side elevation similar to FIG. 1 but shows the exercise device at the inner end of the generally horizontal exercise movement with the seat shown in a raised position and the handlebar in a rear retracted position with the foot pedals in a forward extended position.
Figure 3:
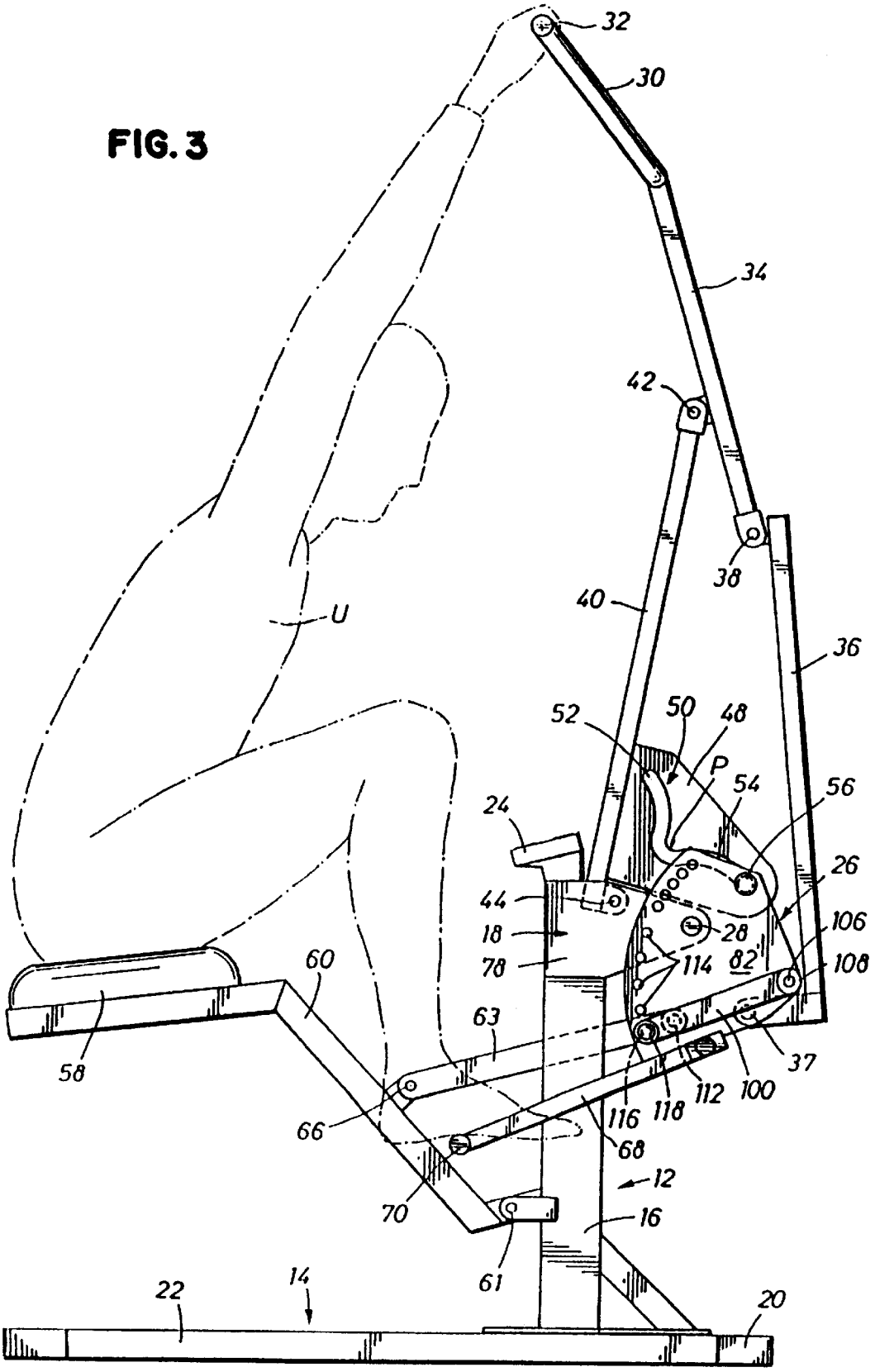
FIG. 3 is a side elevational of the exercise device of FIGS. 1 and 2 after the user has guided the device into vertical pull down mode and the handlebar has moved to its upper extreme position, the illustration showing the commencement of a generally vertical pull down exercise movement in which the seated user is pulling downwardly on the handlebar and pushing forwardly against the foot pedals.

Referring now to the drawings for a better understanding of the invention, and more particularly to FIGS. 1–3, an exercise device of this invention is shown generally at 10 comprising a fixed support frame generally indicated at 12. The fixed support frame 12 includes a base 14 and a vertically extending post 16 having an upper support member 18 secured thereto. Base 14 includes transverse end frame members 20 connected by a horizontal frame member 22.

Figure 5:
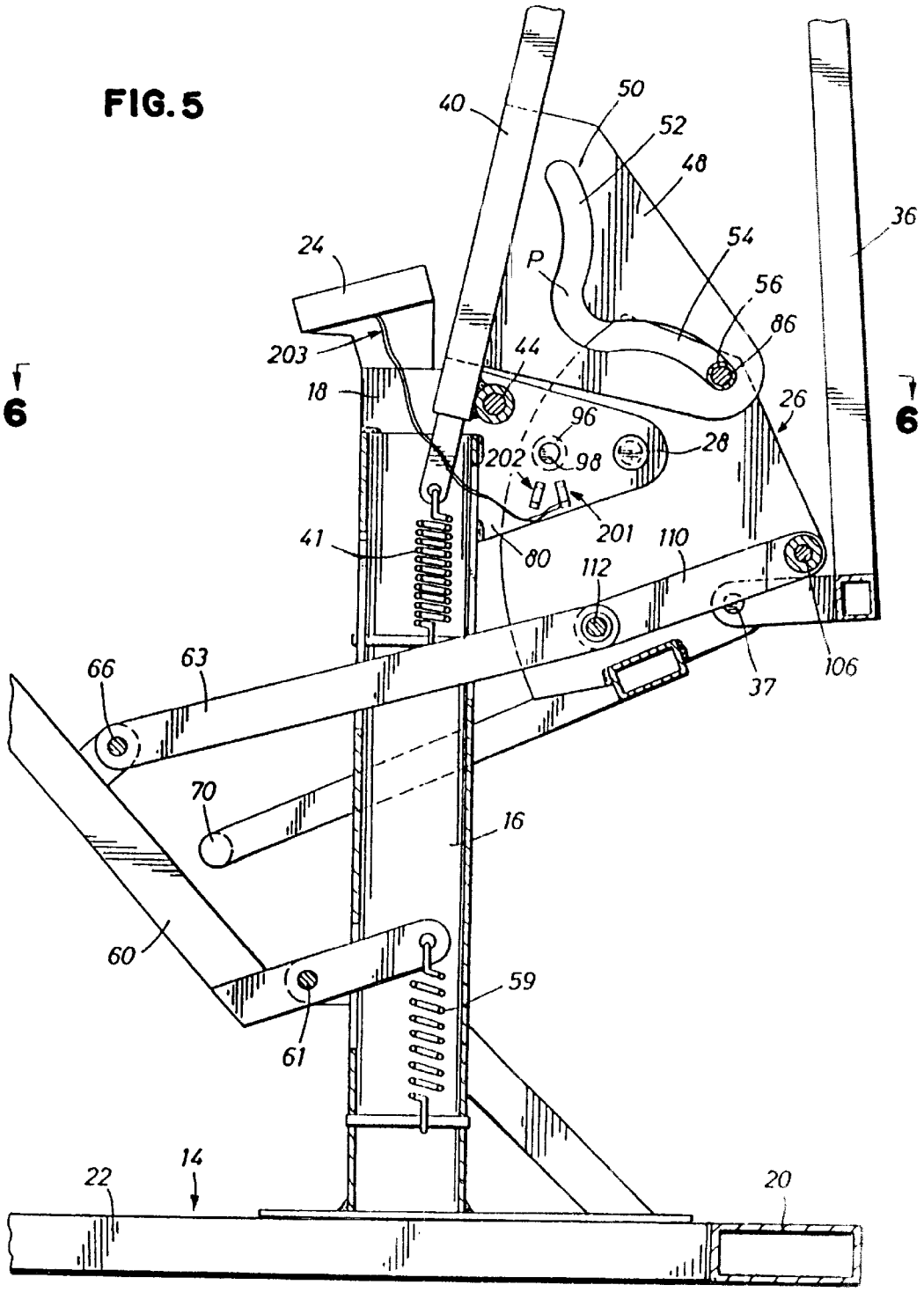
FIG. 5 is an enlarged side elevation of a portion of the exercise device of FIG. 3 with certain parts broken away for illustration.

An adjustment plate member generally indicated at 26 is pivotally mounted about a fixed pivot 28 on upper support member 18. A handlebar 30 includes handgrips 32 and is carried by a handlebar link 34 which is pivotally connected at one end to an end link 36 about pivot 38. The other end of end link 36 is pivotally connected at 37 to adjustment plate member 26. An intermediate link 40 has an upper outer end pivotally mounted at 42 to handlebar link 34 intermediate the length of link 34 and has a lower inner end pivotally mounted at 44 to fixed support member 18. An optional counterbalance spring 41 is connected to the lower end 44 of line 40 as shown in FIG. 5.

A cam plate 48 is fixed to intermediate link 40 by welding or other means known in the art. It has a cam slot 50 which includes a pair of communicating slot portions 52 and 54 which extend in different directions. Slot portions 52, 54 join each other at an intersection point P of slot portions 52, 54 of slot 50. A cam follower 56 secured to adjustment plate member 26 is mounted within the cam slot 50 for guiding the pivotal movement of intermediate link 40 and handlebar 30 relative to the frame 12.

The cam slot portion 52 is designed and arranged in coordination with the design of link members, 34, 40 and 36 such that when cam follower is in slot portion 52, the handgrips 32 of handlebar 30 move in a substantially horizontal direction. FIGS. 1 and 2 illustrate such horizontal movement. The cam portion 54 is designed and arranged in coordination with the design of link members 34, 40 and 36 such that when cam follower is in slot portion 54, the handgrips 32 of handlebar 30 move in a substantially vertical direction. FIG. 3 illustrates vertical movement between the upper most vertical position of handgrips 32 dictated by cam follower 56 in slot portion 54. FIG. 2 shows the cam follower 56 approaching the point P of the intersection of slot portions 52 and 54 which corresponds with the lowermost position of handgrips 32 which is the same point, that is the transition point, as the inner most position of handgrips of horizontal motion. In other words, the user U can repetitively perform a generally horizontal, back and forth exercise by maintaining the cam follower 56 in the slot portion 52, and the user U can repetitively perform a generally vertical, up and down exercise by maintaining the cam follower 56 in the slot portion 54. The user U can move between these two slot portions 52 and 54 simply by driving the cam follower 56 through and beyond the junction P.

The weight of the user U provides resistance to the exercise movements. User U during the exercise movements sits on a seat 58 having a seat frame 60 pivotally mounted at 61 to post 16. A counterbalance spring 59 is connected to link 60. (FIG. 5) A seat connecting link 63 extends through a slot in post 16. One end of the link 63 is pivotally mounted at 66 to seat frame 60. The opposed end is operatively connected to adjustment plate 26 for providing an adjustable resistance to the exercise movements as will be explained further hereinafter and as shown particularly in FIG. 6. A foot support frame shown generally at 68 is generally U-shaped and has a pair of lower foot pedals or rests 70 extending from distal ends thereof and away from one another. A transverse frame member 72 of frame 68 away from one another. A transverse frame member 72 of frame 68 is secured to adjustment plate member 26 for movement therewith. Auxiliary foot rests 74 are provided at opposite ends of transverse frame member 72.

FIGS. 1 and 2 illustrate a generally horizontal exercise movement of handlebar 30 in which user U pulls horizontally on handlebar 30 and simultaneously pushes against foot pedals 70 to rotate adjustment plate member 26 in a counterclockwise direction about pivot 28. FIG. 3 illustrates a generally vertical exercise movement of handlebar 30 in which user U pulls downwardly on handlebar 30 and simultaneously pushes outwardly on foot pedals 70 to rotate adjustment plate member 26 in a counterclockwise direction about pivot 28. As a result of the horizontal exercise movement from FIG. 1 to FIG. 2, user U is lifted vertically on seat 58. The weight of user U tends to rotate plate 26 in a clockwise direction. When the user reduces his muscular force on handlebars 32, the weight of the user returns exercise device 10 to the position of FIG. 1.

FIG. 3 illustrates the commencement of the generally vertical exercise movement by user U. Cam follower 56 in slot portion 54 of cam slot 50 controls the movement of intermediate link 40 and handlebar 30. Follower 56 may move past the intersection point P of slot portions 52 and 54. Accordingly, a user U can select a vertical exercise movement, or a horizontal exercise movement simply by changing the direction of force exerted against handlebar 30. For example, to change or convert from a horizontal movement to a vertical movement, user U pulls rearwardly a maximum amount from the position shown in FIG. 2 so that follower 56 moves into slot portion 54 from slot portion 52 to provide a generally vertical motion for handgrips 32. The weight of the suer causes the machine to move to the position of FIG. 3. A pull down force by the arms of the user returns the machine to a downward position similar to that shown in FIG. 2, but with the cam follower 56 just beneath the junction P, as opposed to just above the junction P.

Figure 6:
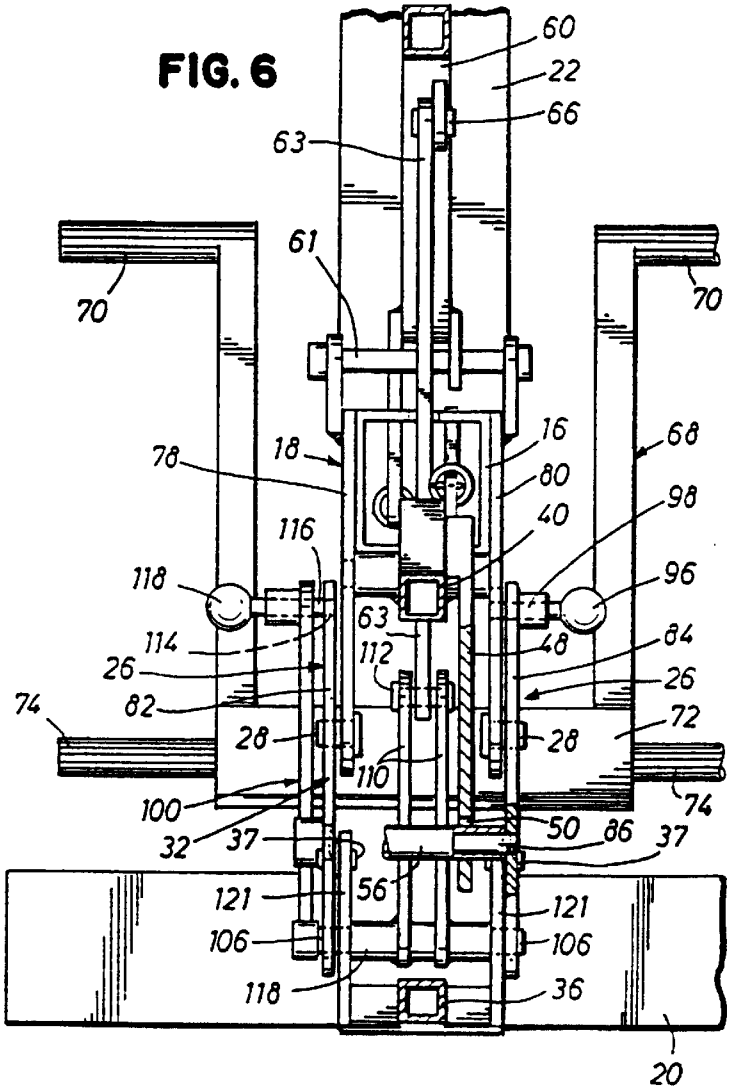
FIG. 6 is a sectioned view taken generally along lines 6—6 of FIGS. 5 which shows particularly the linkages for connecting the seat, handlebar, and foot pedals.
Figure 4:
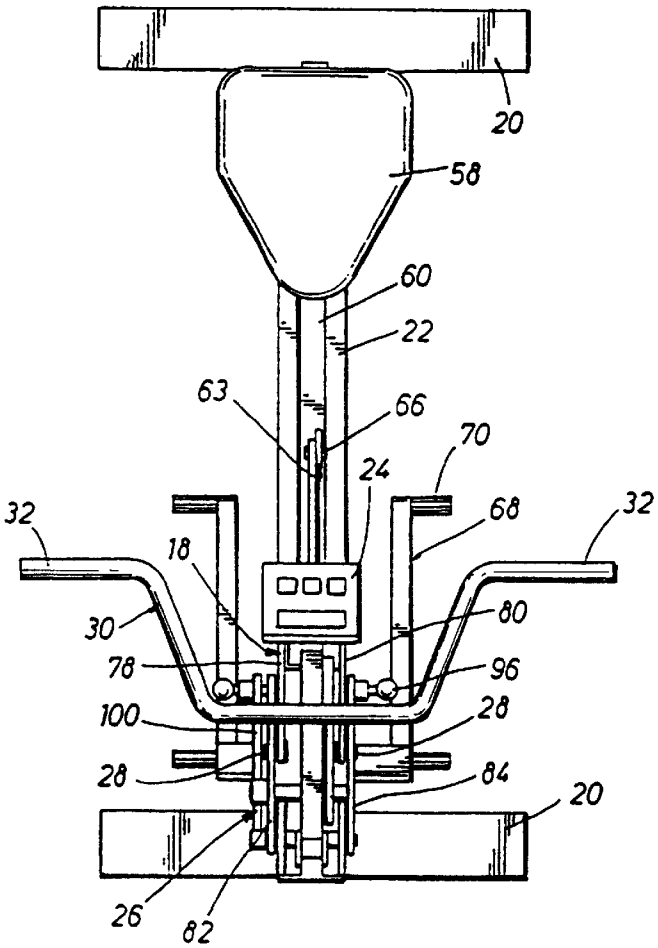
FIG. 4 is a top plan view of the exercise device of FIGS. 1–3, showing the linkages which connect the seat, handlebar, and foot pedals to an adjustment plate member for coordinating the exercise movements and transmitting resistance force.

Referring now particularly to FIG. 6, a downwardly directed, sectioned view of FIG. 5 along lines 6—6 illustrates the functioning of adjustment plate member 26. Upper support plate member 18 includes a pair of parallel supporting plate portions 78 and 80 secured to opposed sides of post 16 as shown in FIG. 4. Adjustment plate member 26 includes a pair of parallel adjustment plates or plate portions 82 and 84 pivotally mounted about fixed pivot 28 on respective fixed supporting plate portions 78 and 80. Adjustment plate portions 82 and 84 are secured to each other by a transverse frame member 72 and a pin 86 disposed within sleeve follower 56, which, in turn, is disposed within slot 50 of cam plate 48. When exercise device 10 is not being used, adjustment plate portion 84 forms a locking plate portion 80 of upper support member 18 to hold or lock adjustment member 26 against any movement. When exercise device is placed in condition for operation, pin member 96 is retracted from opening 98 and held in a retracted position during operation of exercise device 10. A suitable lug (not shown) may be provided to retain pin member 96 in a retracted portion removed from opening 98.

An outer indexing or adjustment lever generally indicated at 100 is fixed at its forward end to a shaft 106 received within openings in adjustment plate portions 82 and 84. A sleeve 118 fixed to shaft 106 extends between plate portions 82 and 84 as shown in FIG. 6 and is free to pivot relative to adjustment plate portions 82 and 84. A pair of parallel inner adjustment levers 110 are fixed to sleeve 118 at one end and are pivotally connected at an opposite end to force applying link 63 about pivot 112. Outer adjustment lever 100 and inner adjustment levers 110 are maintained in transverse alignment with each other at all times because shaft 106 is fixed to outer adjustment lever 100 and also fixed to inner adjustment levers 110 through sleeve 118 which is fixed to shaft 106. Thus, pivot 112 for force applying link 63 is movable with levers 100 and 110 relative to adjustment plate member 26 and remains in transverse alignment with levers 100, 110 at all times.

Outer adjustment lever 100 is manually adjusted relative to force adjustment member 26 for movement of pivot 112 and force applying link 63 to vary the resistance applied against the exercise movements. Adjustment plate portion 82 has a series of openings 114 spaced about an arcuate path. (See FIGS. 1, 2, 3.) A manually retractable pin 116 carried by outer adjustment lever 100 is urged inwardly by a spring. Knob 118 connected to pin 116 may be manually gripped and pulled outwardly for withdrawing pin 116 from one opening 114 for engagement with another selected opening 114. A retaining lug (not shown) for holding pin 116 in a retracted position upon rotation of pin 116 may be provided.

Operation of Exercise Device for Horizontal Movement

FIGS. 1 and 2 illustrate a generally horizontal exercise movement with user U exerting a pulling force on handlebar 30 and a pushing force against foot pedals 70. A user U sits on seat 58 in the lowered position of seat 58 as shown in FIG. 1. Pin member 96 has previously been withdrawn from opening 98 in order to permit rotation of adjustment plate member 26 about pivot 28. The weight of user U is applied through link 63, inner levers 110 and sleeve 108 against adjustment plate member 26 to tend to rotate adjustment plate member 26 in clockwise direction (as viewed from the right hand side of the machine and shown FIG. 1) relative to pivot 28 on support plate member 18. Follower 56 is positioned at the upper end of slot portion 52 of cam slot 50 on cam plate 48 which is secured to link 40. Upon pulling handlebar 32 rearwardly and pushing foot pedals 70 forwardly from the position of FIG. 1, adjustment plate member 16 tends to rotate in counterclockwise direction about pivot 28 until reaching the position shown in FIG. 2.

Rotation of adjustment plate 26 in a counterclockwise direction from the position of FIG. 1 results in the raising of seat 58 and user U seated thereon through sleeve 118, inner levers 110 and force applying link 63. Thus, the weight of user U provides resistance to the horizontal exercise movement. Handlebar 30 is maintained in a generally horizontal direction during the exercise movement by follower 56 in upper cam portion 52 which guides intermediate link 40 in an arc which causes handlebar 30 to move in a generally horizontal direction. To return to the position of FIG. 1 from the position of FIG. 2, the user relaxes the pulling force of his arms exerted against handlebar 30 and his pushing force exerted against foot pedals 70, so that the weight of user U on seat 58 causes the exercise device 10 to return to the position of FIG. 1 in a clockwise movement of adjustment plate member 26 about pivot 28. Cam follower 56, as it nears the end of the pulling action against handlebar 30 as shown in FIG. 2, is positioned adjacent the intersection P of cam slot portions 52 and 54. During the horizontal exercise movement, follower 56 remains in cam portion 52.

As illustrated in FIG. 5 is a console 24 secured to the upper end of port 16. Such console is positioned so that it is visible to user U for visually representing exercise characteristics through use of the device, such as time, repetition rate, and the like. A repetition counting arrangement includes a magnet 201 mounted on the rotating adjustment plate member 26 (by adhesive or other means known in the art), and a Hall effect sensor 202 (or other magnetic sensor) mounted on stationary upper support member 18 (by adhesive or other means known in the art). The arrangement of the magnet 201 and the sensor 202 is such that the magnet 201 passes the sensor 202 each time the handle 30 is moved through either the horizontal path of motion or the vertical path of motion. The sensor 202 generates a measurable pulse each time the magnet 201 passes the sensor 202. The pulse is transmitted to the console 24 by means of a cable 203 interconnected therebetween. Those skilled in the art will recognize that a microprocessor or other electronics in the console 24 may be programmed or arranged to generate various performance characteristics based on the number and frequency of generated pulses.

Operation of Exercise Device for Vertical Exercise Movement

FIGS. 3 and 5 show a generally vertical exercise movement utilizing handlebar 30. To convert from the horizontal exercise movement to the vertical exercise movement, user U pulls handlebar 30 rearwardly a maximum amount from the position of FIG. 2 so that cam follower 56 moves through the intersection P of cam slot portions 52 and 54 into cam slot portion 54. Relaxation of the force exerted on hand grips 32 causes adjustment member 26 to rotate clockwise which causes handlebar 30 to raise to the position of FIG. 2 with cam follower 56 at the end of cam slot portion 54. FIG. 3 shows the position in which the vertical exercise movement is commenced with a downward pulling of handlebar 30 and pushing against foot pedals 70. The movement of adjustment plate member 26 for the vertical exercise movement shown in FIG. 3 is similar to the movement of adjustment plate member 26 for the horizontal exercise movement as shown in FIGS. 1 and 2. The primary difference is that the cam follower 56 is positioned in cam slot portion 54, which is designed and arranged in cooperation with linkages 40 and 34 and 36 to cause handgrips 32 to move in a generally vertical direction. Thus, at the discretion of user U, either a generally horizontal exercise movement or a generally vertical exercise movement may be performed. If desired, the generally vertical exercise movement may be combined with the generally horizontal exercise movement and performed alternatingly by movement of handlebar 30 a maximum amount for movement of follower 56 alternatingly in portions 54 and 52.

Cam plate 48 and follower 56 thus control the movement of handlebar 30 and handgrips 32. Various methods of limiting the travel of follower 56 in cam plate 48 may be provided which would therefore limit the motion of handlebar 30. Other mechanisms for controlling the position of link 40 and thereby controlling the path of handgrips 32 while exercising may be provided. For example, an electronic positioning device that controls the position of link 40 throughout the exercise movement may be substituted for the cam plate 48, cam follower 56 mechanism of FIGS. 1–6. Such device, which can be a servomechanism can cause the path of the handlebar 30 to move in at least two arcuate sections of varying radii, or an arcuate section and a linear section or in a closed loop.

Figure 7:
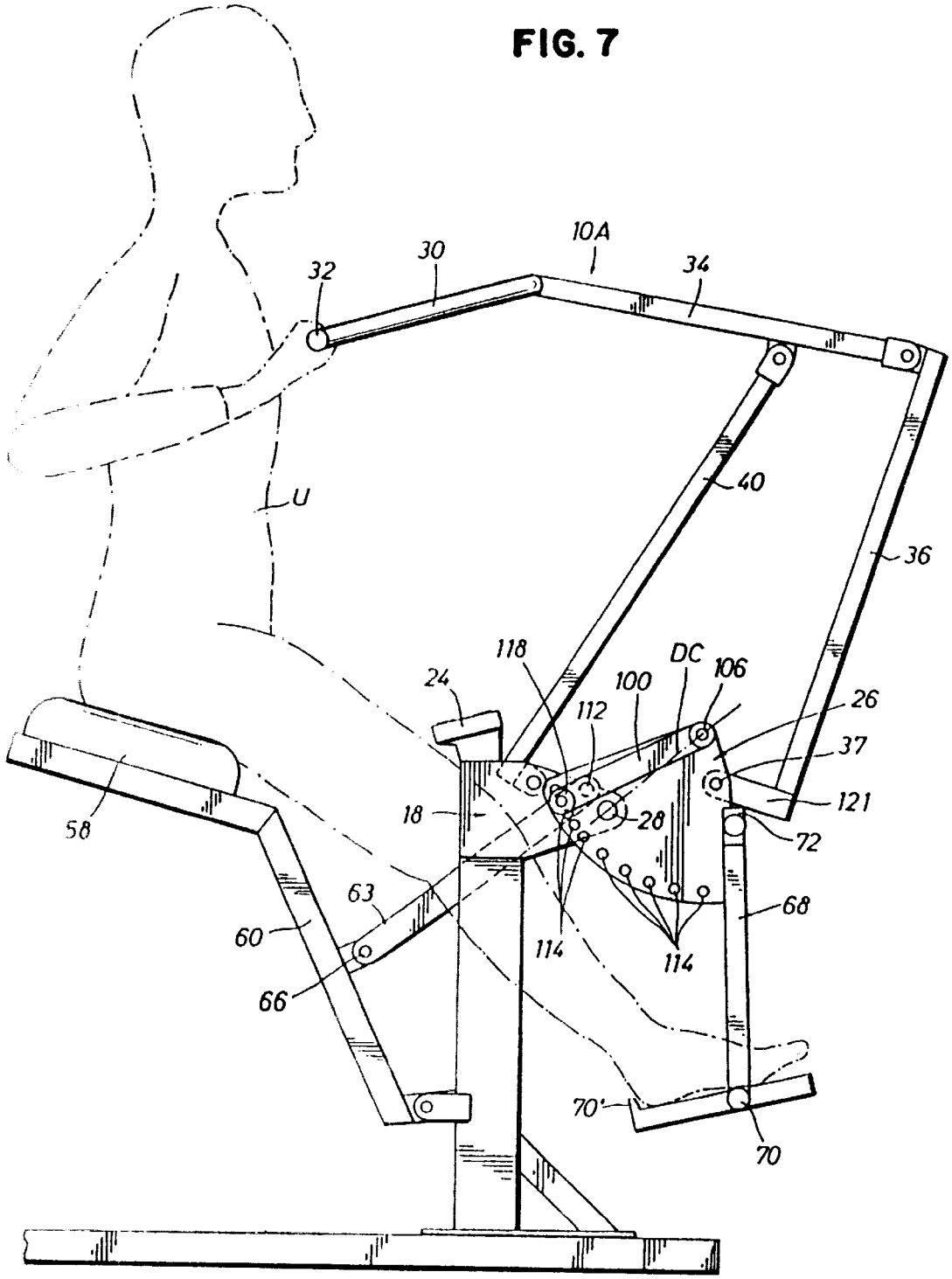
FIG. 7 is a side elevation of an exercise device similar to the exercise device of FIGS. 1–6 but shows a manually adjustable lever for adjusting the resistance applied against the adjustment plate member to an uppermost position past a dead center position of the adjustment lever for effecting pivoting of the adjustment plate member in a reverse direction, the exercise device shown in position for commencement of an exercise movement in which the user pushes the handlebar outwardly and pulls inwardly on the foot pedals, the device of FIG. 7 having no cam arrangement, so that exercises are not restricted exclusive to generally horizontal or vertical movements.
Figure 8:
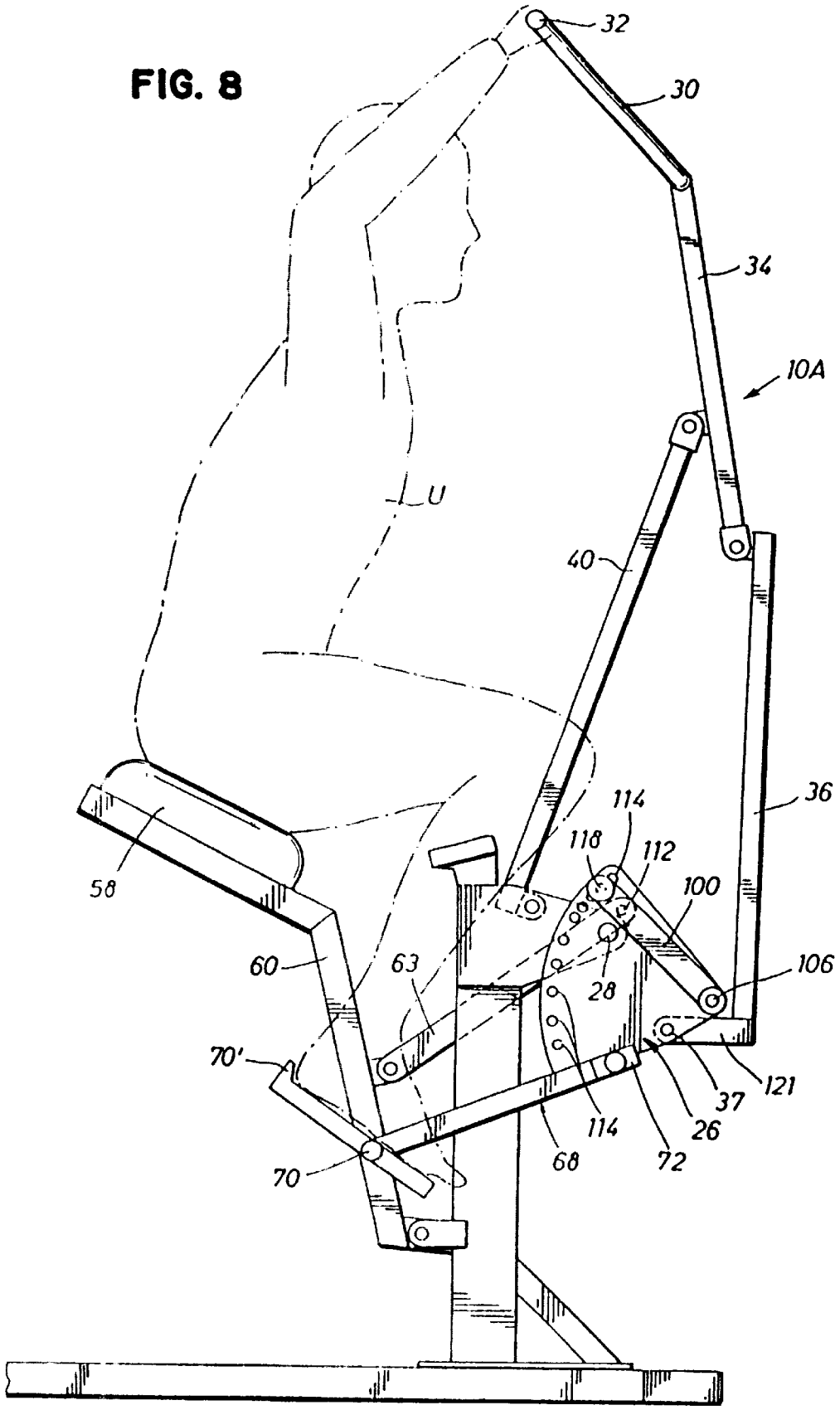
FIG. 8 is a view similar to FIG. 7 but shows the position of the exercise device at the outward portion of the exercise movement illustrated in FIG. 7.

In some instances, it might be desirable to have a free movement of handlebar 32 so that a user U may pull handlebar 30 in any desired direction such as s 45 degree angle to the horizontal. If this is desired, follower 56 may be removed from cam slot 50 of cam plate 48 thereby de-coupling the adjustment plate from link 40. FIGS. 7 and 8 illustrate the removal of cam plate 48 from the preferred embodiment of the invention of FIGS. 1–6.

Variation of Resistance Force

The resistant force may be varied by adjustment of force adjustment lever 100. As shown in FIGS. 1 and 2, adjustment lever 100 is positioned at the lowermost opening 114 in adjustment plate member 26 for the application of a maximum return torque to member 26 from the weight of user U. To reduce such resistance, adjustment lever 100 may be moved upwardly to another selected opening 114 by outwardly pulling of knob 118 for retraction of pin 116 and movement of lever 100 to the desired opening 114. Inner levers 110 along with pivot 112 are moved simultaneously with outer lever 100 because lever 100 is fixed to shaft 106 which in turn is fixed to sleeve 118 for simultaneous movement with adjusting lever 100. The closer that lever 100, (and consequently levers 110 (FIG. 6) are aligned with pivot 28, the less return torque resistance is applied to the motion of handlebars 30.

Operation of Exercise Device for Pushing Handlebar

FIGS. 7 and 8 illustrate an exercise movement in which the user U pushes outwardly on handlebar 30 and pulls inwardly against heel supports 70' of foot pedals 70 against the resistance provided by the weight of user U on seat 58. The exercise apparatus 10A shown in FIGS. 7 and 8 is similar in certain respects to that shown in FIGS. 1–6 except for the removal of the cam plate 48 and follower 56 shown in FIGS. 1–6 for guiding of handlebar 30 to move exclusively in horizontal or vertical directions during the exercise movement. The pushing exercise movement is accomplished by moving of adjustment lever 100 along with pivot 112 to a position past a dead center position or axis as shown by the broken line DC on FIGS. 7 and 8 extending between pivots 28 and 106 for adjustment plate member 26. By movement of adjustment lever 100 and pivot 1123 past the dead center position along axis labeled DC, the force exerted by the weight of user U tends to rotate adjustment plate member 26 in a counterclockwise direction about pivot 28 as shown in FIG. 7. An outward pushing action by user U against handlebar 30 and an inward pulling action against heel supports 70' of foot rests or pedals 70, depending on the angle of force applied against handgrips 32, can move the linkages 34, 40 and 36 to an extreme horizontal position (not shown). Release of the pushing force against handgrips 32 causes the machine to return to the position of FIG. 7. Alternatively, the user may push upwardly against handgrips, thereby bringing the machine to the configuration of FIG. 8. At the end of the exercise movement shown in FIG. 8 and the relaxing of any force exerted by user U, the weight of user U returns exercise device 10A to the position of FIG. 7. The exercise device of FIGS. 1–6 can of course also be used for pushing exercises by changing the position of adjustment lever 100.

From the above description of preferred embodiments of the invention, it is apparent that an exercise device has been provided on which a user may perform various exercise movements with resistance provided by the weight of a user in a seated position. The user may easily change the movement of a handlebar gripped by the user from a generally horizontal exercise movement to a generally vertical exercise movement by changing the motion exerted by the user against the handlebar. The user may, if desired, exercise only the upper limbs by utilizing only the handlebar, or exercise only the lower limbs by utilizing only the foot pedals. If the cam plate is removed from the exercise device, the handlebar is free to move at any angle, either in a pulling motion or in a pushing motion between the vertical and the horizontal directions. Such movements are controlled only by the direction of force exerted by the user against the handlebar.

Additional Embodiments

Figure 9:
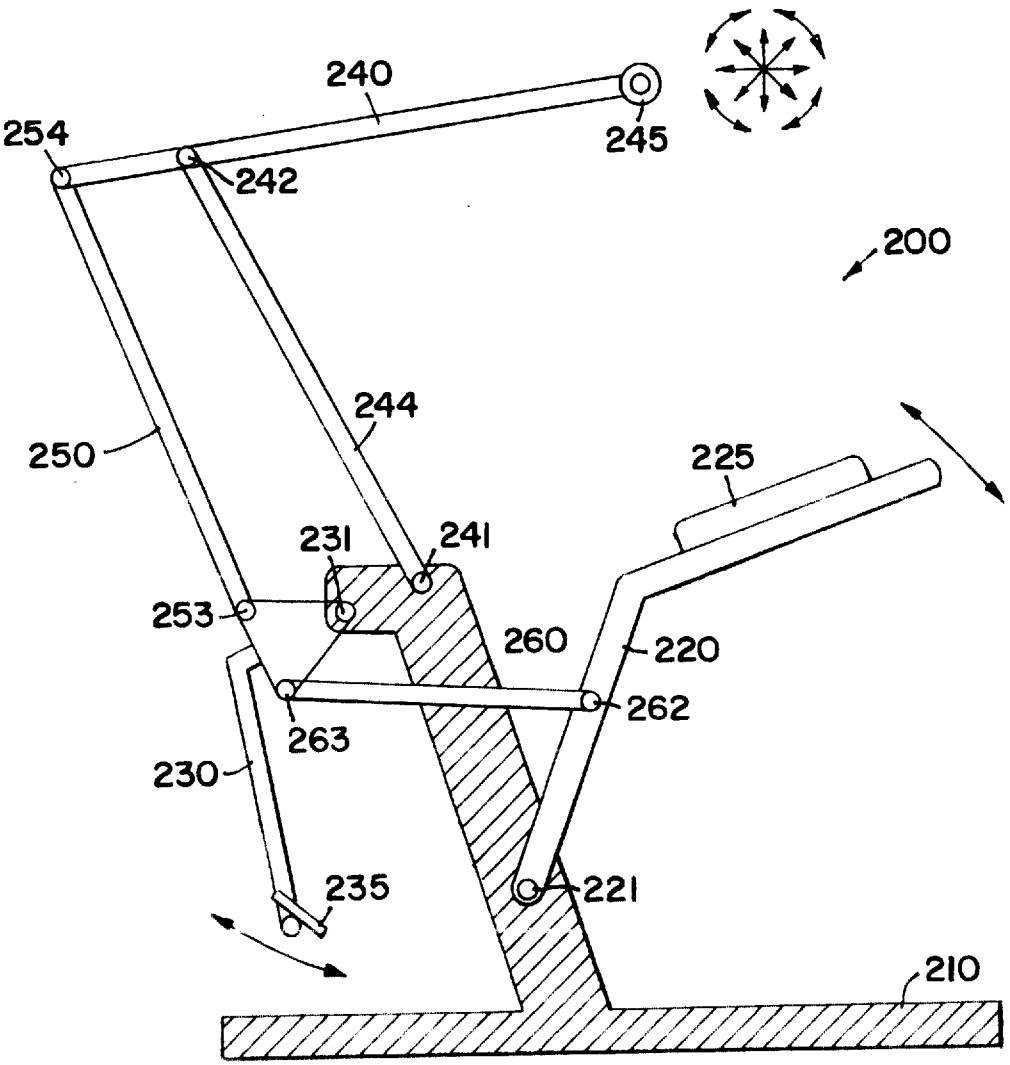
FIGS. 9–25 illustrate alternative embodiments of the invention.

FIG. 9 is a side view of another exercise apparatus 200 constructed according to the principles of the present invention. The apparatus 200 generally includes a frame 210; a seat supporting link 220 movably connected to the frame 210 at a fixed pivot axis 221; a seat 225 mounted on an opposite end of the seat supporting link 220; a foot supporting link 230 movably connected to the frame 210 at a fixed pivot axis 231; at least one foot support 235 mounted on an opposite end of the foot supporting link 230; a hand supporting link 240 movably connected to the frame 210 via intermediate link 244; and at least one handle 245 mounted on an opposite end of the hand supporting link 240. The intermediate link 244 and the frame 210 define a fixed pivot axis 241, and the intermediate link 244 may be locked against rotation relative to the frame 210. The intermediate link 244 and the hand supporting link 240 define a pivot axis 242 which is selectively movable in an arc centered about the fixed pivot axis 241. The hand supporting link 240 may be locked against rotation relative to the intermediate link 244.

A handle connecting link 250 is movably interconnected between the hand supporting link 240 and the foot supporting link 230, and cooperates therewith to define respective pivot axes 254 and 253. As suggested by the arrows in FIG. 9, the handle connecting link 250 links arcuate movement of the foot support 235 to movement of the handle 245 in any direction within the plane of the drawing sheet. The pivot axis 254 may be described as a floating axis because it is not constrained to travel along a single path (unless a lock is imposed on one of the pivot axes 241 or 242). A seat connecting link 260 is movably interconnected between the seat supporting link 220 and the foot supporting link 230, and cooperates therewith to define respective pivot axes 262 and 263. As suggested by the arrows in FIG. 9, the seat connecting link 260 links arcuate movement of the seat 225 to arcuate movement of the foot support 235.

Figure 10:
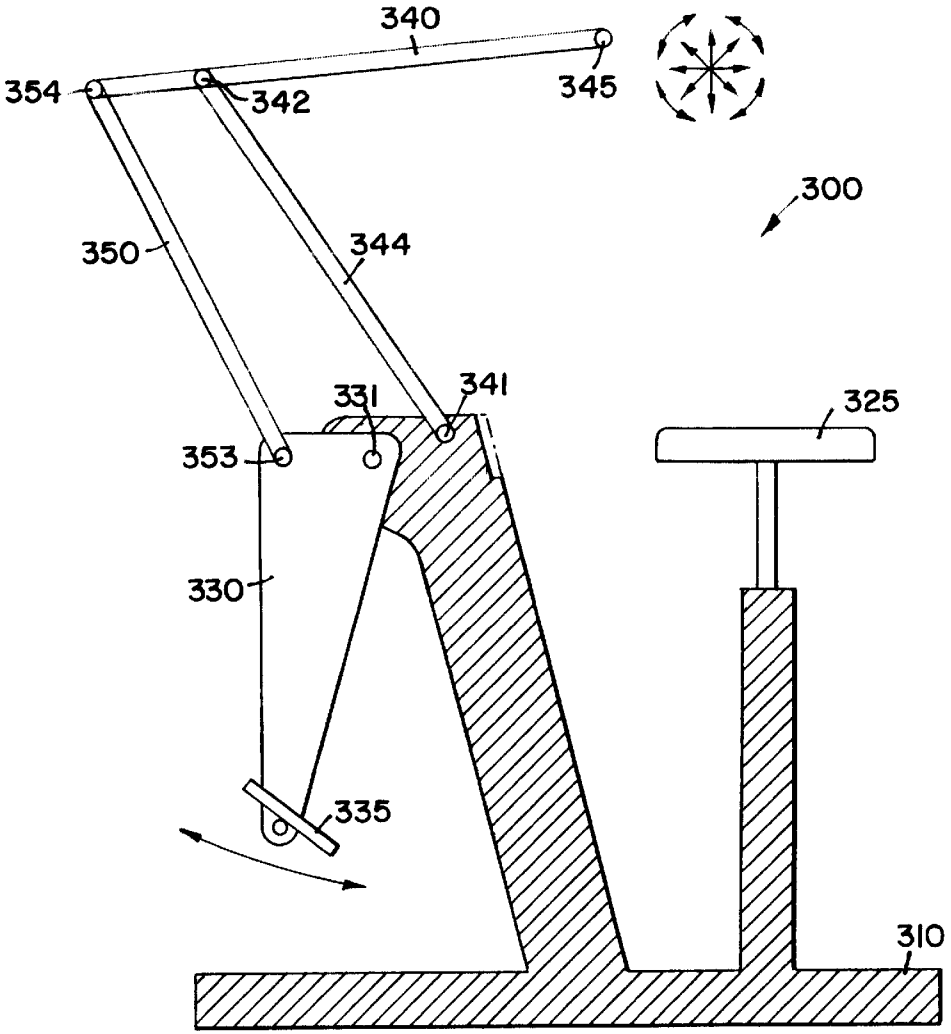

FIG. 10 is a side view of another exercise apparatus 300 constructed according to the principles of the present invention. The apparatus 300 is similar in many respects to the apparatus 200, but has a seat 325 which is anchored relative to the frame 310. The apparatus 300 further includes a foot supporting link 330 movably connected to the frame 310 at a fixed pivot 331; at least one foot support 335 mounted on an opposite end of the foot supporting link 330; a hand supporting link 340 movably connected to the frame 310 via intermediate link 344; and at least one handle 345 mounted on an opposite end of the hand supporting link 340. The intermediate link 344 and the frame 310 define a fixed pivot axis 341, and the intermediate link 344 may be locked against rotation relative to the frame 310. The intermediate link 344 and the hand supporting link 340 define a pivot axis 342 which is selectively movable in an arc centered about the fixed pivot axis 341. The hand supporting link 340 may be locked against rotation relative to the intermediate link 344.

A handle connecting link 350 is movably interconnected between the hand supporting link 340 and the foot supporting link 330, and cooperates therewith to define respective pivot axes 354 and 353. As suggested by the arrows in FIG. 10, the handle connecting link 350 links arcuate movement of the foot support 335 to movement of the handle 345 in any direction within the plane of the drawing sheet. The pivot axis 354 may be described as a floating axis because it is not constrained to travel along a single path (unless a lock is imposed on one of the pivot axes 341 or 342).

Figure 11:
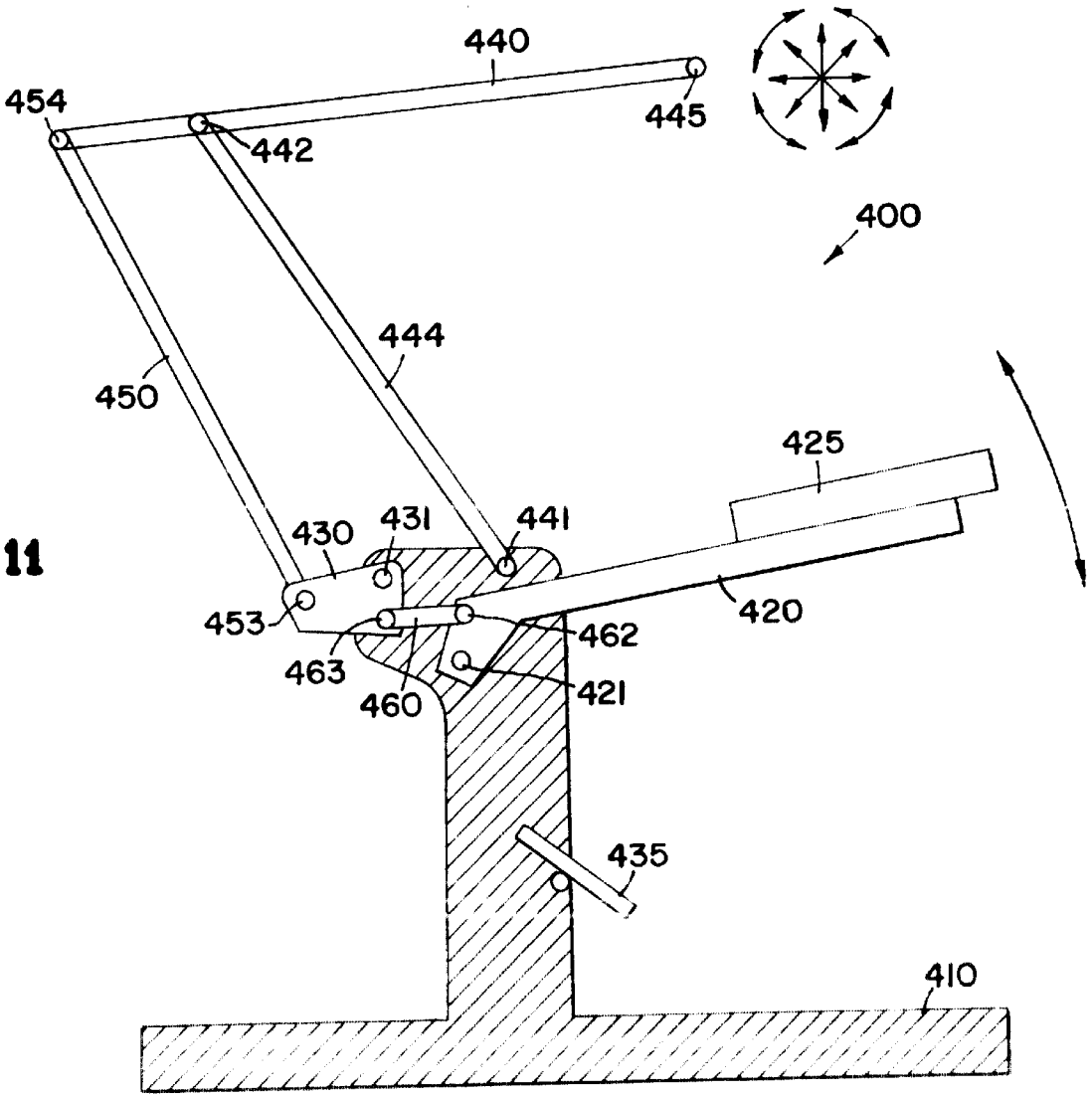

FIG. 11 is a side view of another exercise apparatus 400 constructed according to the principles of the present invention. The apparatus 400 is similar in many respects to the apparatus 200, but has a foot support 435 which is anchored relative to the frame 410. The apparatus 400 further includes a seat supporting link 420 movably connected to the frame 410 at a fixed pivot axis 421; a seat 425 mounted on an opposite end of the seat supporting link 420; a connector link 430 movably connected to the frame 410 at a fixed pivot axis 431; a hand supporting link 440 movably connected to the frame 410 via intermediate link 444; and at least one handle 445 mounted on an opposite end of the hand supporting link 440. The intermediate link 444 and the frame 410 define a fixed pivot axis 441, and the intermediate link 444 may be locked against rotation relative to the frame 410. The intermediate link 444 and the hand supporting link 440 define a pivot axis 442 which is selectively movable in an arc centered about the fixed pivot axis 441. The hand supporting link 440 may be locked against rotation relative to the intermediate link 444.

A handle connecting link 450 is movably interconnected between the hand supporting link 440 and the connecting link 430, and cooperates therewith to define respective pivot axes 454 and 453. The pivot axis 454 may be described as a floating axis because it is not constrained to travel along a single path (unless a lock is imposed on one of the pivot axes 441 or 442). A seat connecting link 460 is movably interconnected between the seat supporting link 420 and the connecting link 430, and cooperates therewith to define respective pivot axes 462 and 463. As suggested by the arrows in FIG. 11, arcuate movement of the seat 425 is linked to movement of the handle 445 in any direction within the plane of the drawing sheet.

Figure 12:
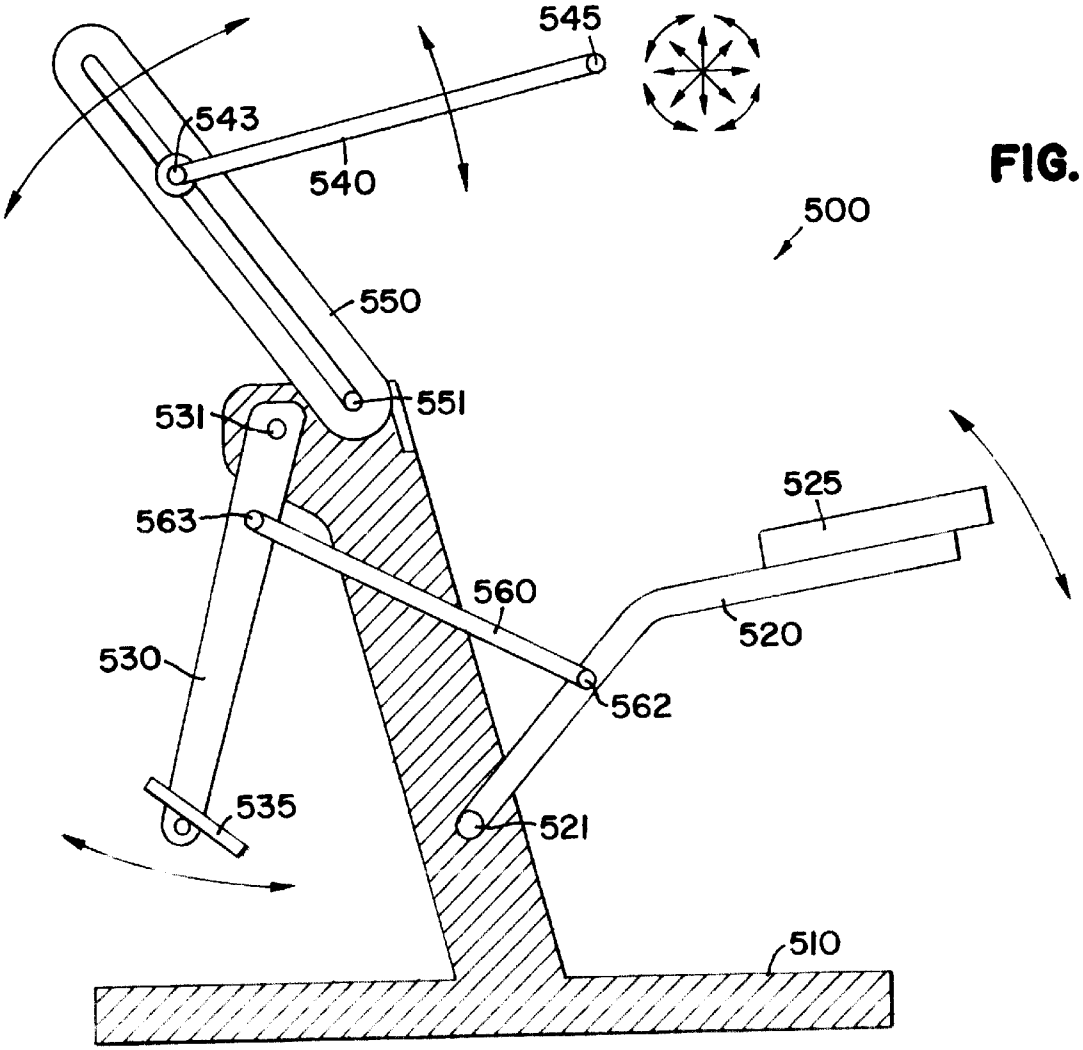
Figure 13:
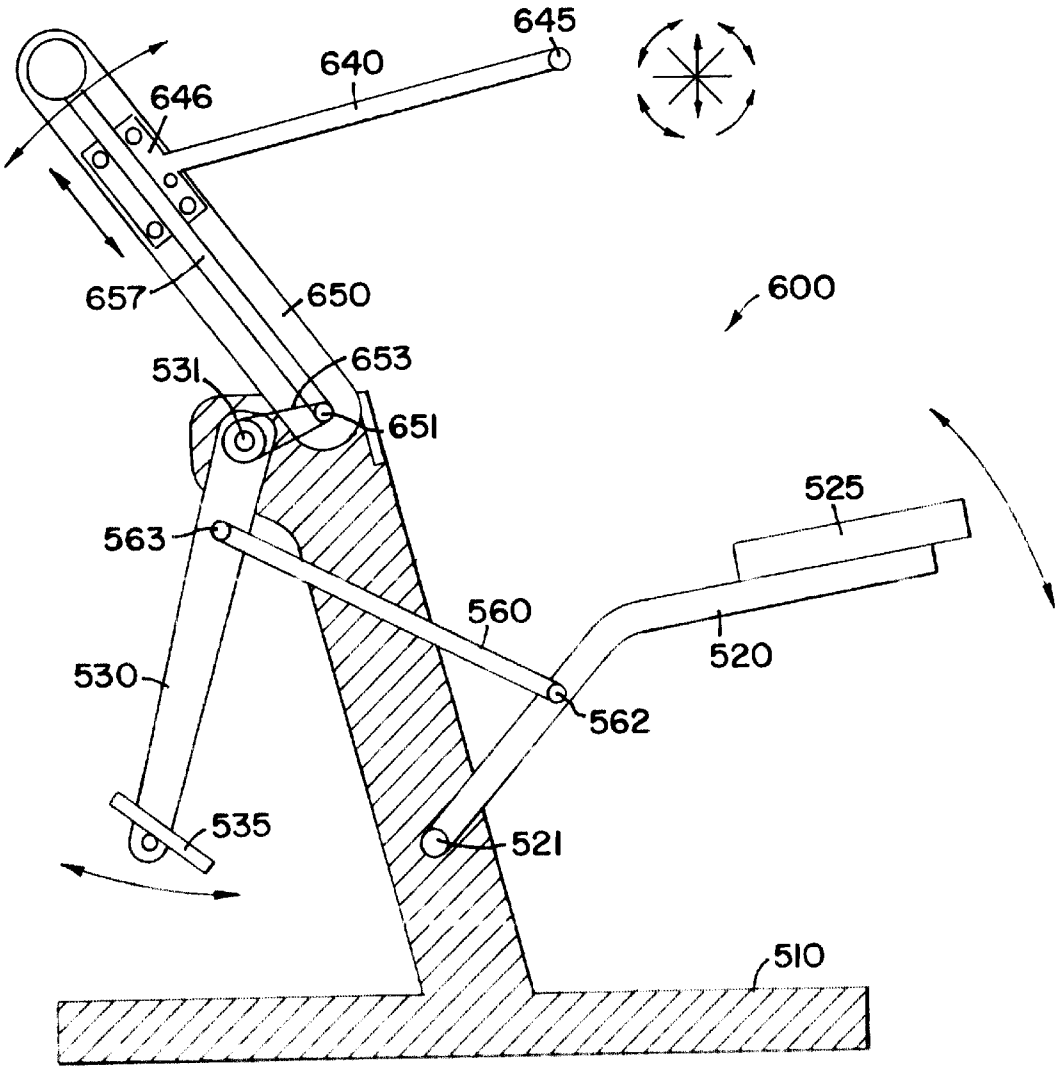

FIGS. 12 and 13 are side views of alternative embodiments 500 and 600 constructed according to the principles of the present invention. Each includes a frame 510 designed to rest upon a floor surface. A seat supporting link 520 has a first end movably connected to the frame 510 at a fixed pivot axis 521. A seat 525 is mounted on an opposite end of the seat supporting link 520. A foot supporting link 530 has an upper end movably connected to the frame 510 at a fixed pivot axis 531. At least one foot support 535 is mounted on an opposite end of the foot supporting link 530. A seat connecting link 560 is movably interconnected between an intermediate portion of the seat supporting link 520 and an intermediate portion of the foot supporting link 530, thereby defining respective pivot axes 562 and 563. As suggested by the arrows in FIGS. 12 and 13, the seat connecting link 560 links arcuate movement of the seat 525 to arcuate movement of the foot support 535.

As shown in FIG. 12, the exercise apparatus 500 further includes a hand supporting link 540 having a first end movably connected to the frame 510 via intermediate link 550. At least one handle 545 is mounted on an opposite end of the hand supporting link 540. The intermediate link 550 is rotatable about a fixed pivot axis 551 relative to the frame 510, and may be locked against rotation relative to the frame 510. The intermediate link 550 and the hand supporting link 540 define a pivot axis 543, which is movable along the intermediate link 550, and which is movable in an arc centered about the fixed pivot axis 551. The hand supporting link 540 may be locked against translation and/or rotation relative to the intermediate link 550.

As shown in FIG. 13, the exercise apparatus 600 further includes a hand supporting link 640 having a first end movably connected to the frame 510 via intermediate link 650. At least one handle 645 is mounted on an opposite end of the hand supporting link 640. The intermediate link 650 is rotatable about a fixed pivot axis 651 relative to the frame 510, and may be locked against rotation relative to the frame 510. The hand supporting link 640 is movable along the intermediate link 650, and may be locked against translation relative to the intermediate link 650. A belt 653 is interconnected between the intermediate link 650 and the foot supporting link 530.

Figure 14:
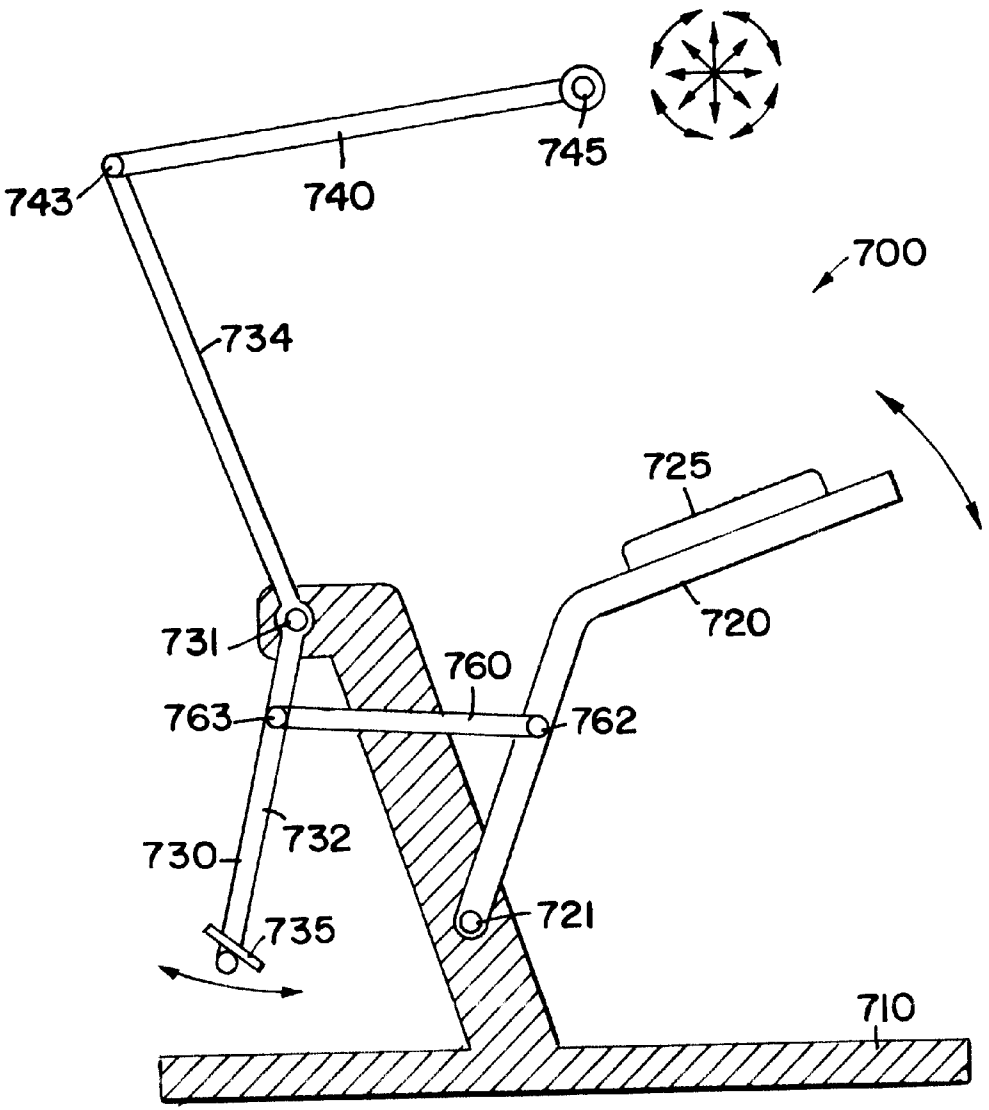

FIG. 14 is a side view of another exercise apparatus 700 constructed according to the principles of the present invention. The apparatus 700 is similar in many respects to the apparatus 200, but includes relatively fewer links. The apparatus 700 includes a frame 710; a seat supporting link 720 movably connected to the frame 710 at a fixed pivot axis 721; a seat 725 mounted on an opposite end of the seat supporting link 720; a connector link 730 movably connected to the frame 710 at a fixed pivot axis 731; at least one foot support 735 mounted on a lower end of the connector link 730; a hand supporting link 740 movably connected to an upper end of the connector link 730 at a moving pivot axis 743; and at least one handle 745 mounted on an opposite end of the hand supporting link 740. The connector link 730 may be locked against rotation relative to the frame 710 and/or the hand supporting link 740.

A seat connecting link 760 is movably interconnected between the seat supporting link 720 and the connecting link 730, and cooperates therewith to define respective pivot axes 762 and 763. As suggested by the arrows in FIG. 14, arcuate movement of the seat 725 is linked to arcuate movement of the foot support 735.

Figures 15A, 15B, 15C:
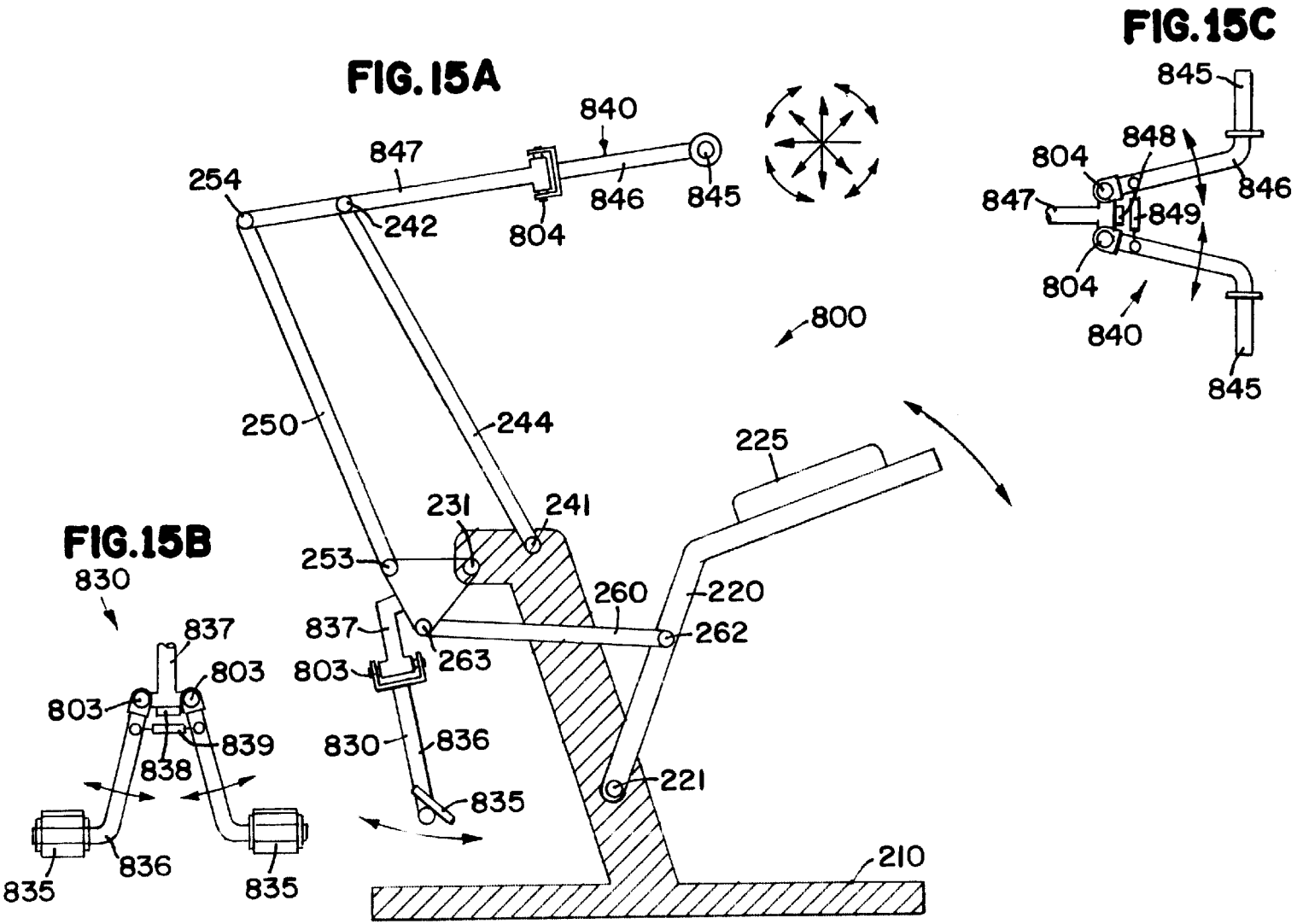

FIG. 15*a* is a side view of another exercise apparatus 800 constructed according to the principles of the present invention. As suggested by the common reference numerals, the apparatus 800 is similar in many respects to the exercise apparatus 200 shown in FIG. 9. In fact, the only differences between the two exercise machines 200 and 800 regard the foot supporting assembly 830 shown in FIG. 15*b*, and the hand supporting assembly 840 shown in FIG. 15*c*.

The foot supporting assembly 830 includes an upper bar 837 and left and right lower bars 836 which are connected to the upper bar 837 at respective pivots 803. The lower bars 836 may be locked against pivoting relative to the upper bar 837. Pedals 835 are mounted on opposite ends of respective bars 836 to support a person's feet. A stop 838 is disposed between the bars 836, proximate the pivots 803, and a spring 839 is interconnected between the bars 836. As suggested by the arrows in FIGS. 15*a* and 15*b*, the pedals 835 are pivotal about two orthogonal axes (at 803 and 231).

The hand supporting assembly 840 includes a first bar 847 and left and right second bars 846 which are connected to the first bar 847 at respective pivots 804. The second bars 846 may be locked against pivoting relative to the first bar 847. Handles 845 are mounted on opposite ends of respective bars 846 to support a person's hands. A stop 848 is disposed between the bars 846, proximate the pivots 804, and a spring 849 is interconnected between the bars 846. As suggested by the arrows in FIGS. 15*a* and 15*c*, the handles 845 are pivotal about two orthogonal axes (at 804 and 242 or 241).

Figure 16:
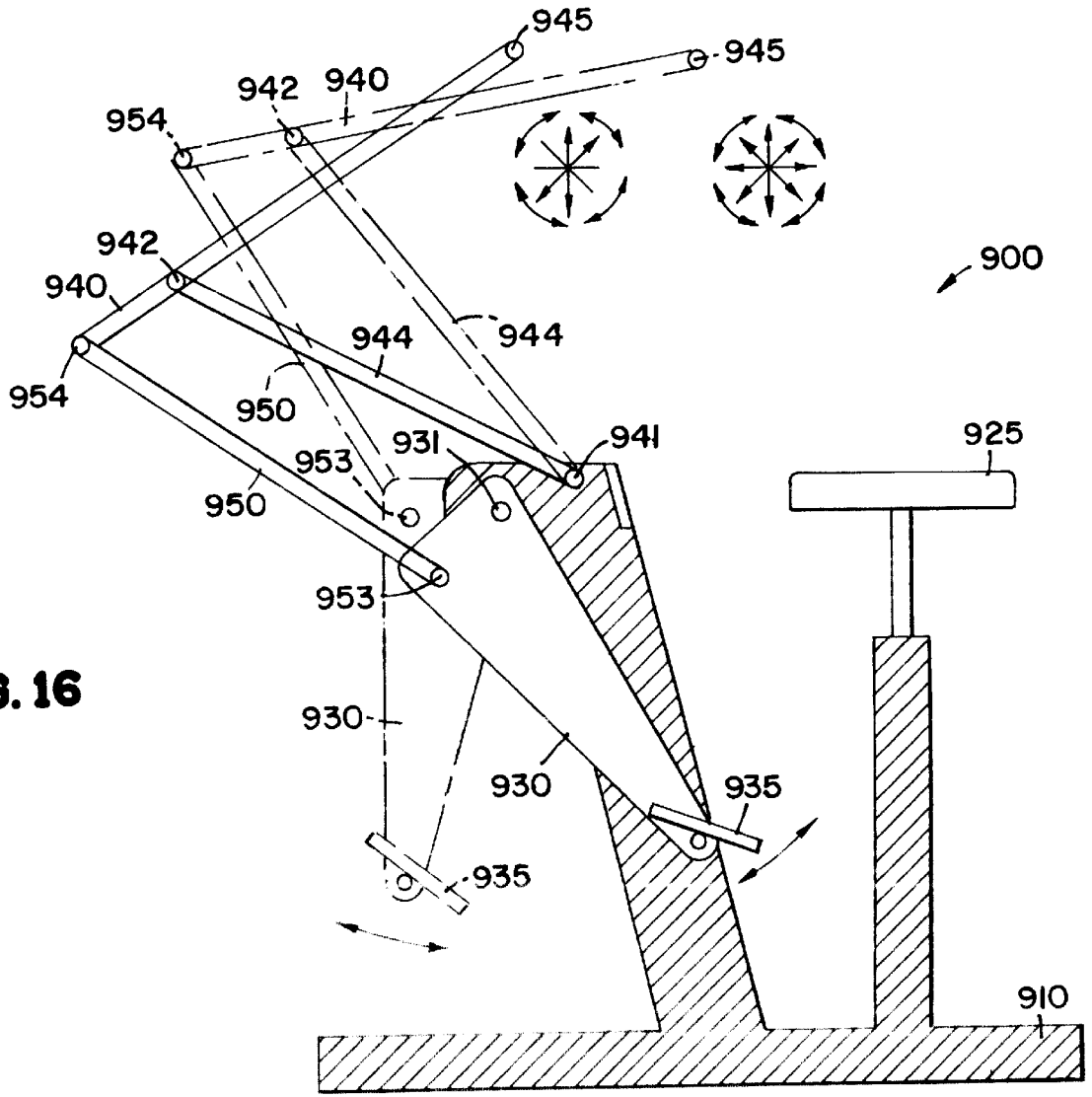

FIG. 16 is a side view of another exercise apparatus 900 constructed according to the principles of the present invention. The apparatus 900 generally includes a frame 910; a seat 925 mounted on the frame 910; left and right foot supporting links 930 movably connected to the frame 910 at a common pivot axis 931; left and right foot supports 935 mounted on respective foot supporting links 930; left and right hand supporting links 940 movably connected to the frame 910 via respective intermediate links 944; and respective handles 945 mounted on respective hand supporting links 940. The intermediate links 944 and the frame 910 define a common pivot axis 941, and the intermediate links 944 may be locked against rotation relative to the frame 910. Each intermediate link 944 and respective hand supporting link 940 define a respective pivot axis 942 which is selectively movable in an arc centered about the fixed pivot axis 941. Each hand supporting link 940 may be locked against rotation relative to a respective intermediate link 944.

Left and right handle connecting links 950 are movably interconnected between respective hand supporting links 940 and respective foot supporting links 930, thereby defining respective pivot axes 954 and 953. As suggested by the arrows in FIG. 16, the handle connecting links 950 link arcuate movement of respective foot supports 935 to movement of respective handles 945 in any direction within the plane of the drawing sheet. The pivot axes 954 may be described as "floating" because they are not constrained to travel along a single path (unless a lock is imposed on one of the pivot axes 241 or 242).

Figure 17:
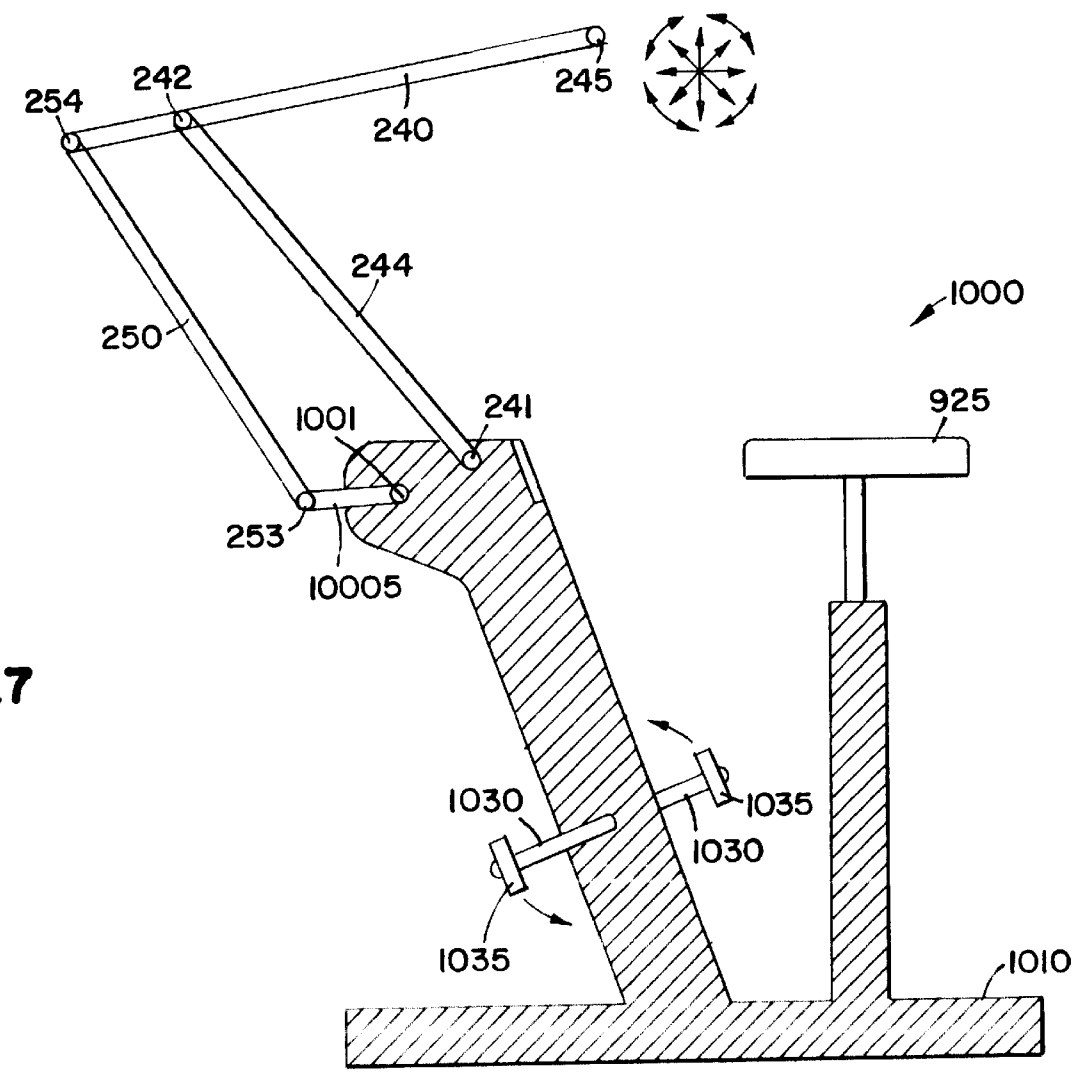

FIG. 17 is a side view of another exercise apparatus 1000 constructed according to the principles of the present invention. As suggested by the common reference numerals, the apparatus 1000 is similar in certain respects to the exercise apparatus 900 shown in FIG. 16, and similar in certain other respects to the exercise apparatus 200 shown in FIG. 9. Unlike the arrangement on the apparatus 200, a simple bar 1005 is rotatably interconnected between the frame 1010 and the lower end of the handle connecting link 250. The bar 1005 is rotatable about a fixed pivot axis 1001 relative to the frame 1010, and the bar 1005 cooperates with the handle connecting link 250 to define the floating pivot axis 253, which pivots about the fixed pivot axis 1001. Left and right crank arms 1030 are rotatably mounted on the frame 1010, and left and right pedals 1035 are mounted on distal ends of respective crank arms 1030.

Figure 18:
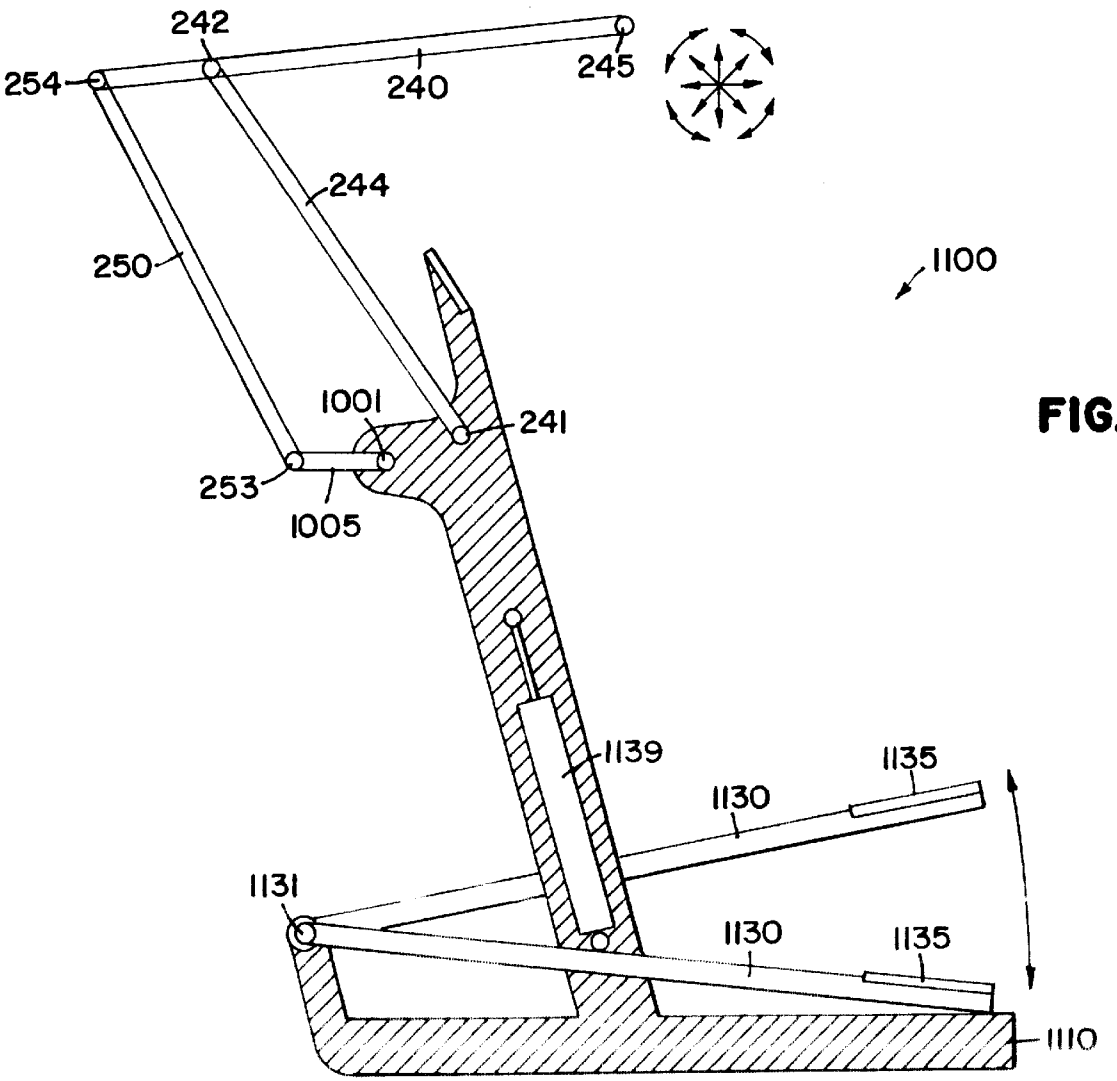

FIG. 18 is a side view of another exercise apparatus 1100 constructed according to the principles of the present invention. As suggested by the common reference numerals, the apparatus 1100 is similar in certain respects to the exercise apparatus 1000 shown in FIG. 17. However, the seat 925 and the bicycle cranks 1030 have been replaced by a stair stepping assembly. In particular, left and right lever arms 1130 have forward ends pivotally mounted to the frame 1110 at pivot axis 1131. Left and right foot supports 1135 are mounted on opposite ends of respective lever arms 1130. Movement resisting cylinders 1139 are interconnected between respective lever arms 1130 and the frame 1110.

Figure 19:
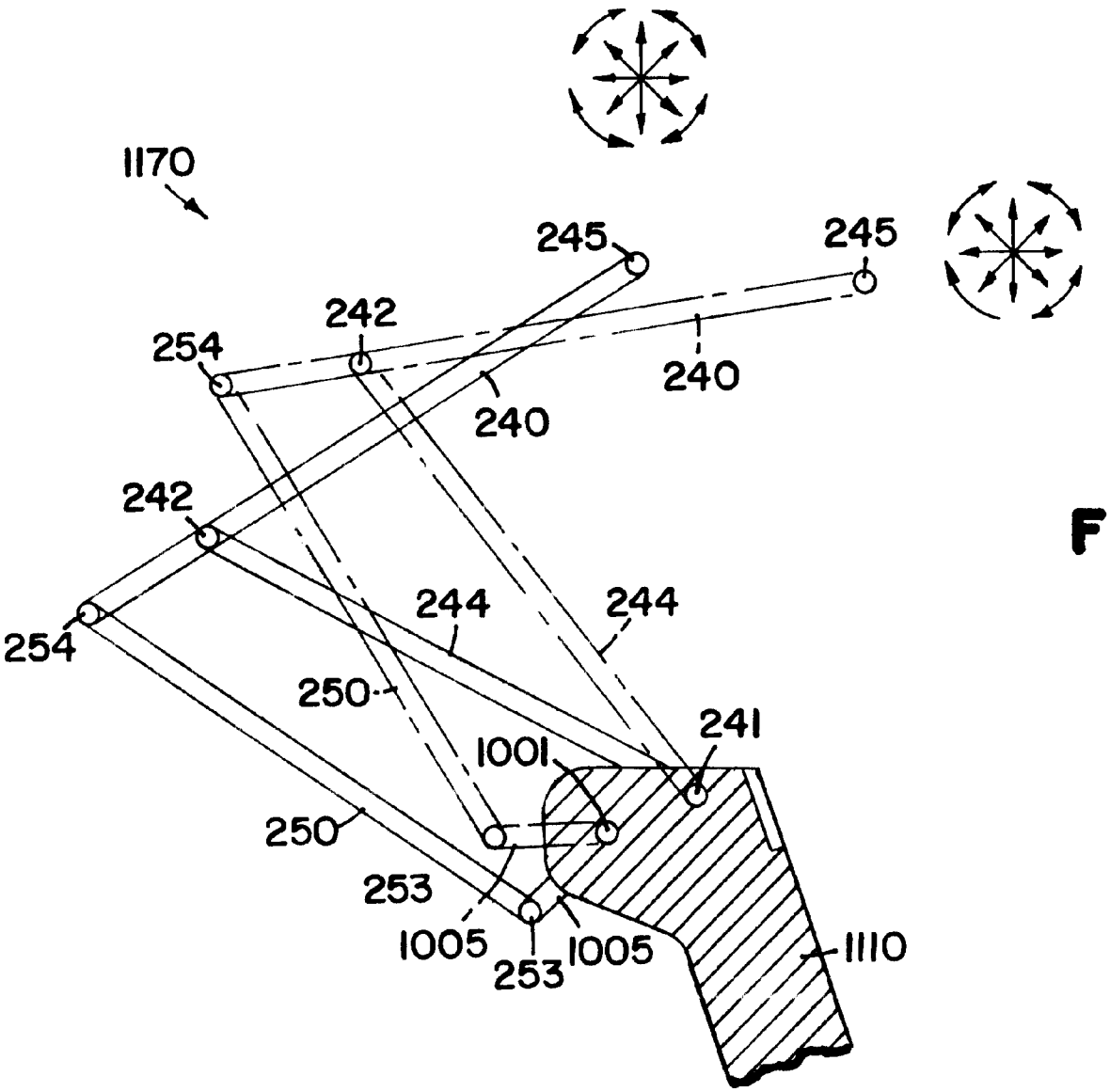

FIG. 19 is a side view of an alternative hand supporting assembly 1170 constructed according to the principles of the present invention. As suggested by the common reference numerals, the assembly 1170 includes separate left and right hand supporting linkages like the one hand supporting linkage on the apparatus 1100 shown in FIG. 18.

Figure 20:
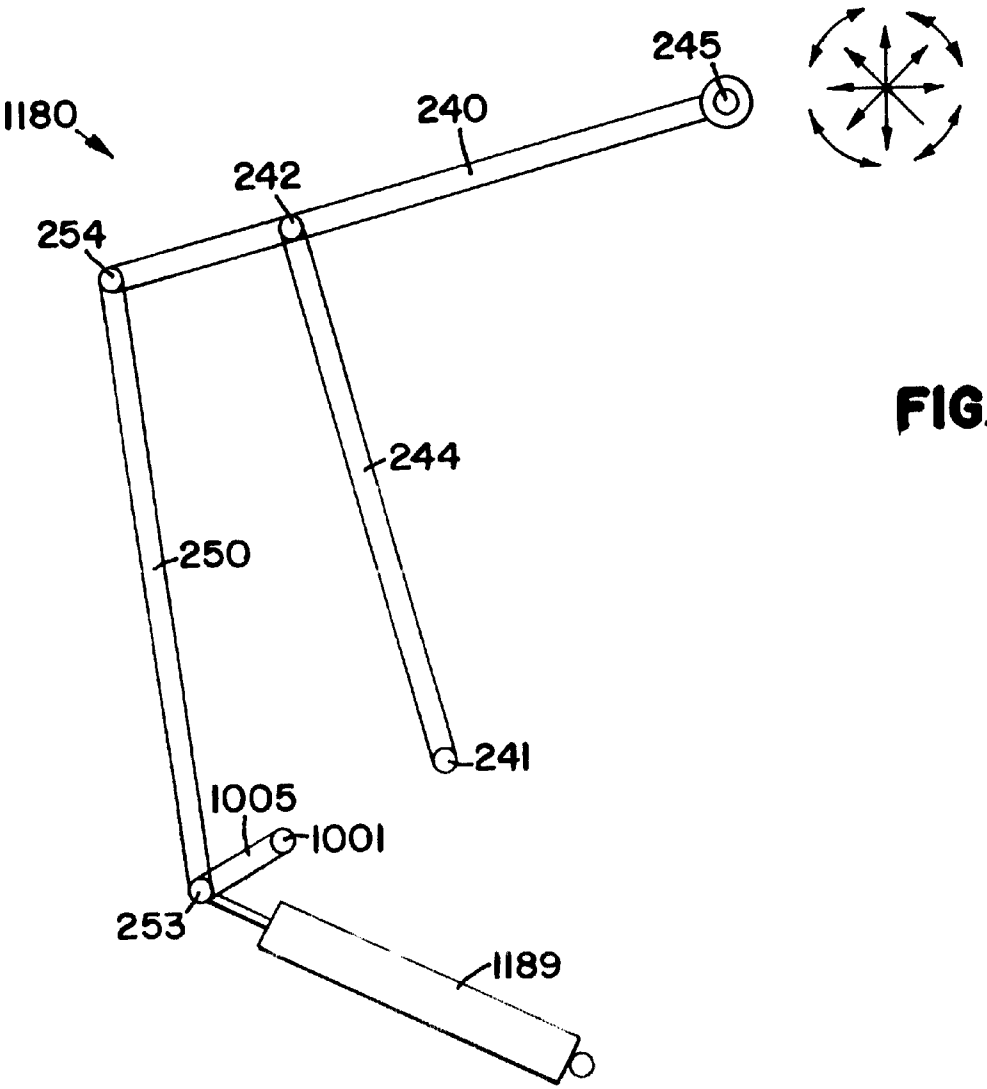

FIG. 20 is a side view of an alternative hand supporting assembly 1180 constructed according to the principles of the present invention. As suggested by the common reference numerals, the assembly 1180 includes a hand supporting linkage like that on the apparatus 1100 shown in FIG. 18. In addition, a movement resisting cylinder 1189 is interconnected between the pivot 253 and the frame (not shown). The cylinder 1189 provides common resistance to horizontal and vertical movement of the handle 245.

Figure 22:
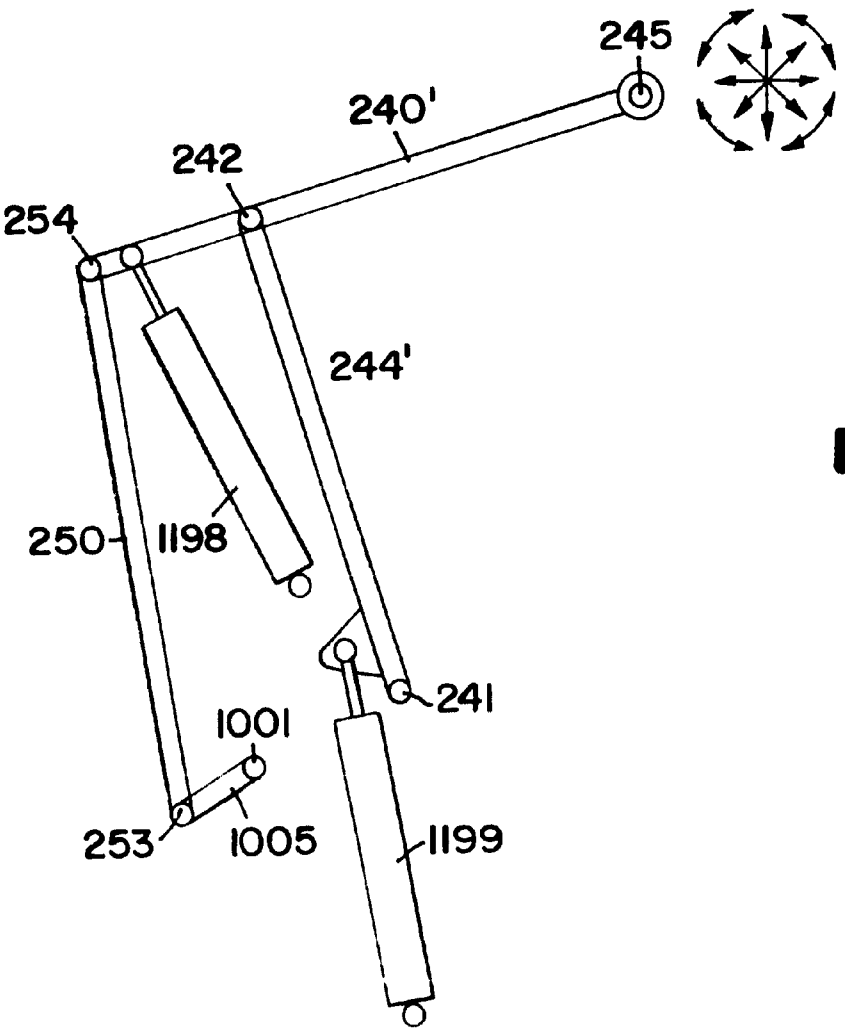

FIG. 22 is a side view of an alternative hand supporting assembly 1190 constructed according to the principles of the present invention. As suggested by the common reference numerals, the assembly 1190 includes a hand supporting linkage like that on the apparatus 1100 shown in FIG. 18. In addition, a first movement resisting cylinder 1198 is interconnected between the frame (not shown) and the hand supporting link 240' (proximate the pivot 254). Also, a second movement resisting cylinder 1199 is interconnected between the frame (not shown) and the intermediate link 244' (proximate the pivot 241). The adjustable force cylinders 1198 and 1199 provide separate resistance to horizontal and vertical movement of the handle 245.

Figure 21:
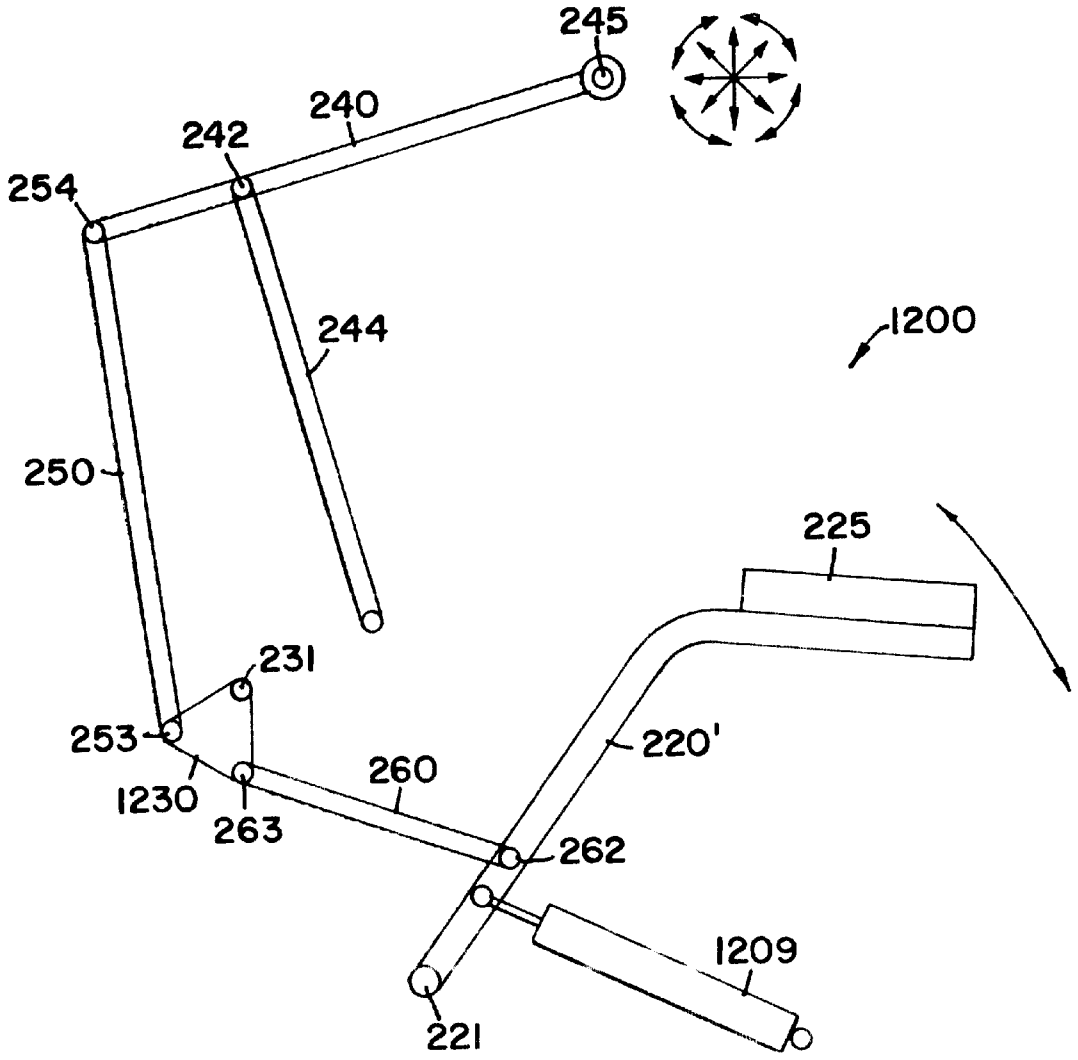

FIG. 21 is a side view of an exercise apparatus 1200 constructed according to the principles of the present invention and similar in many respects to the exercise apparatus 200 shown in FIG. 9. A movement resisting cylinder 1209 is interconnected between the frame (not shown) and the seat supporting link 220' (proximate the pivot 262). The cylinder 1209 provides common resistance to movement of the handle 245 and the seat 225.

Figure 23:
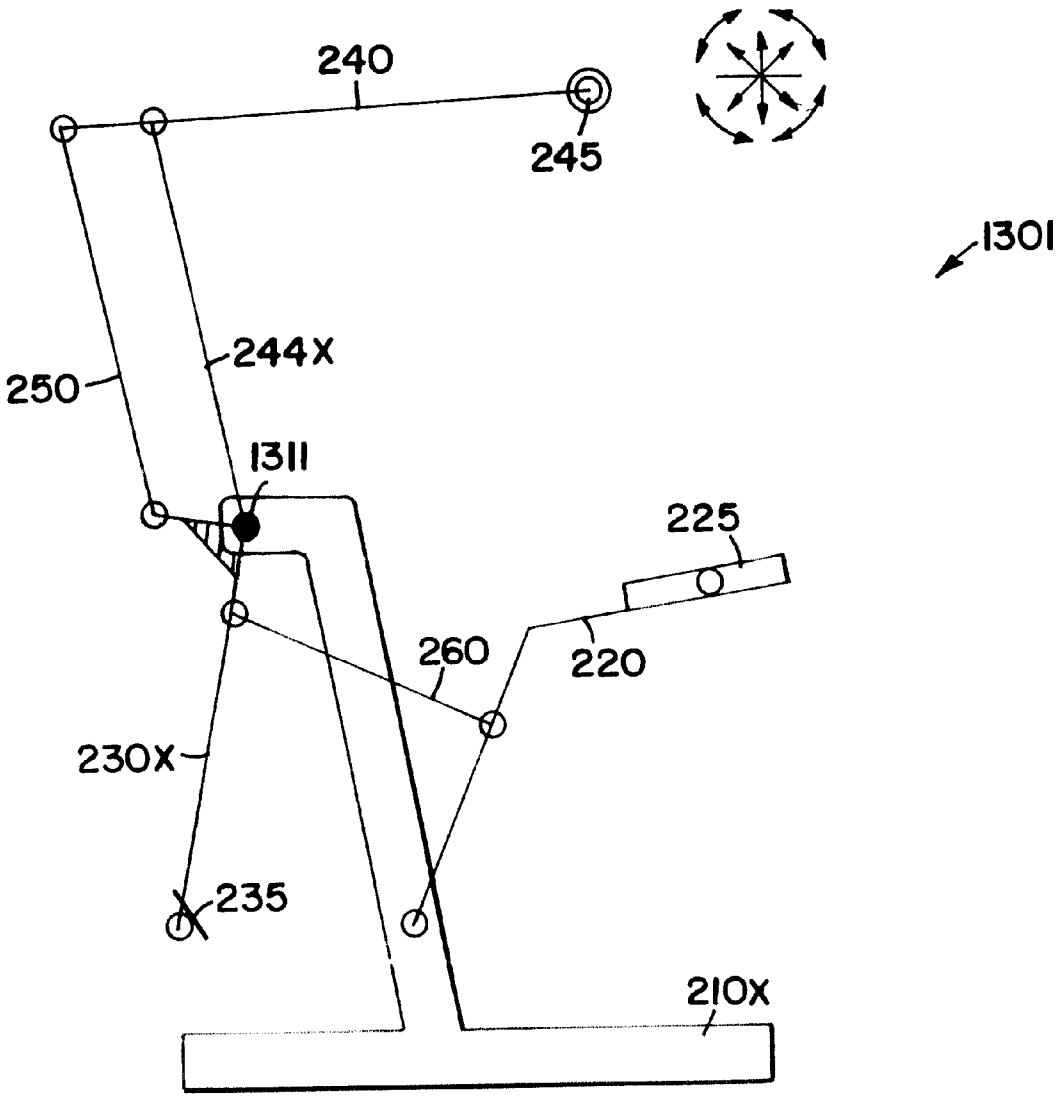
Figure 24:
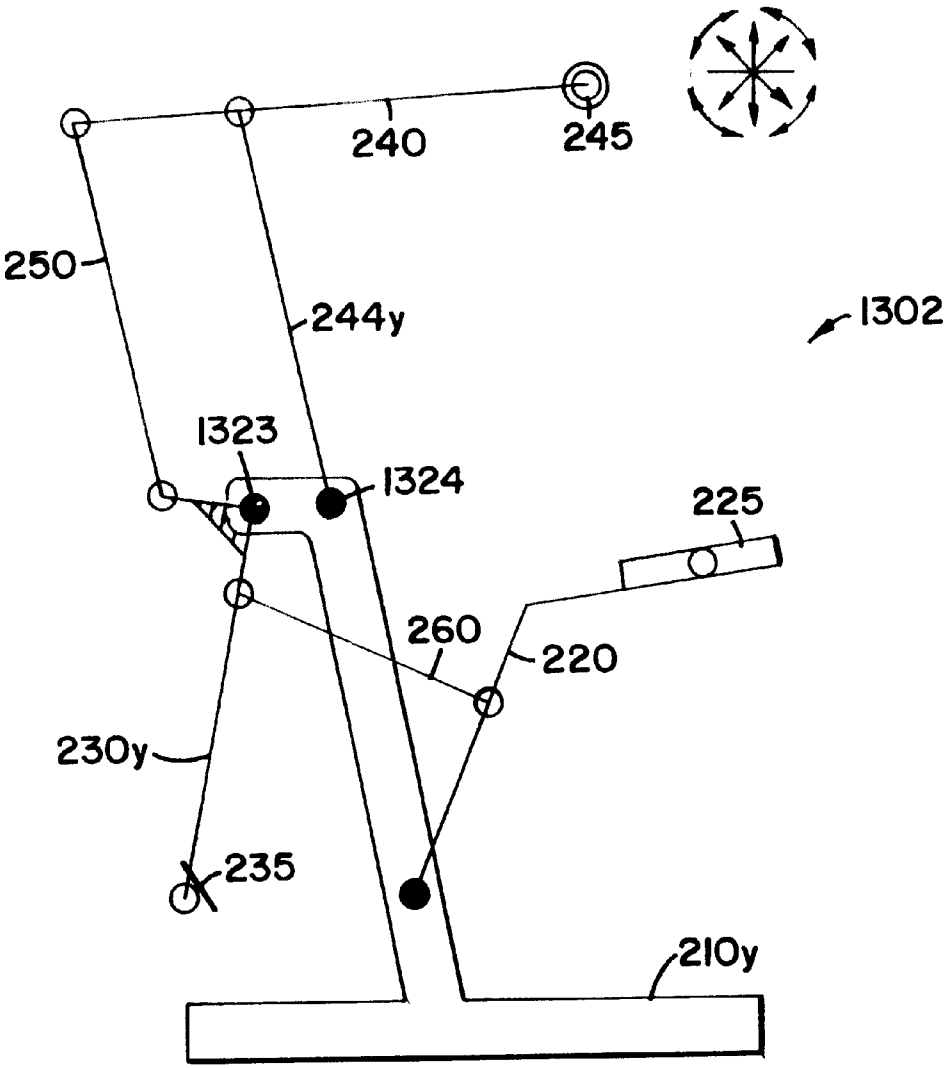
Figure 25:
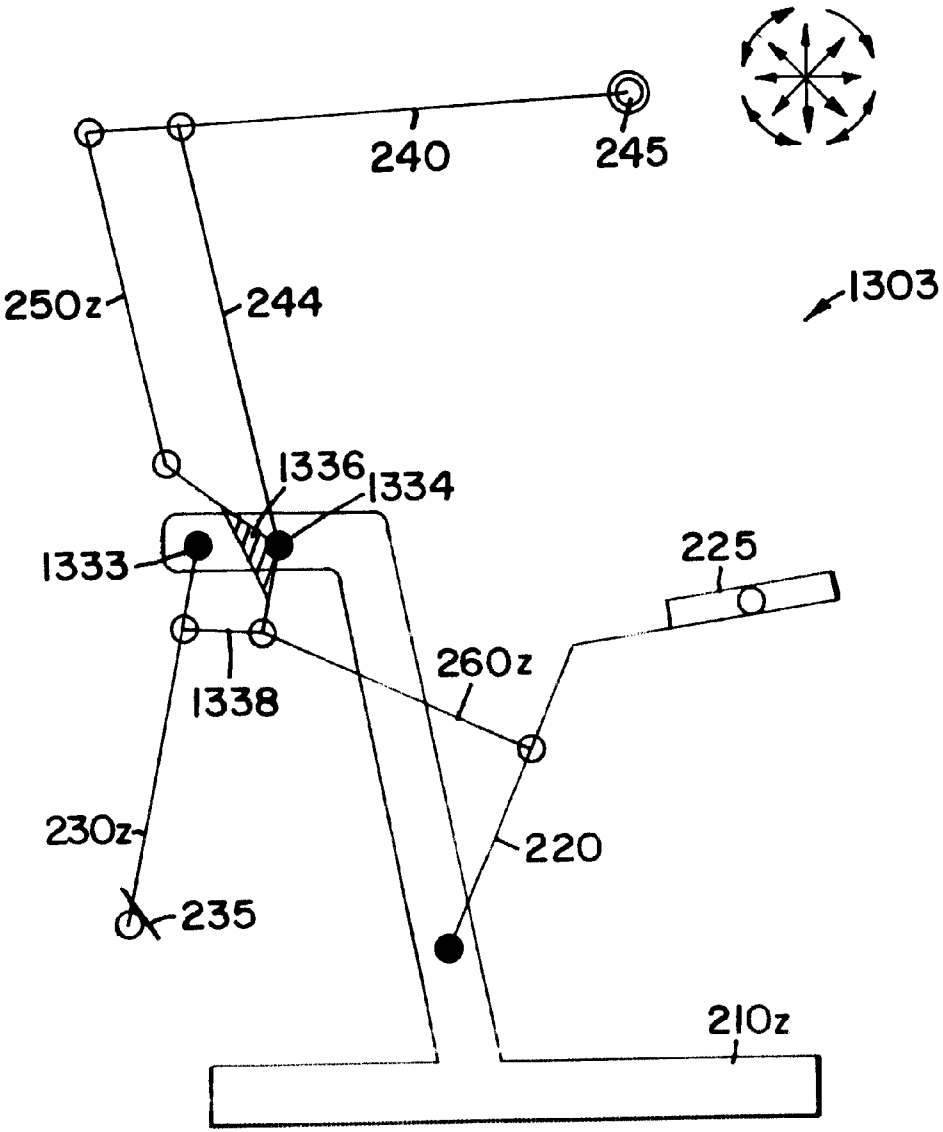

FIGS. 23–25 are schematic side views of exercise apparatus 1301, 1302, and 1303, respectively, demonstrating alternative pivot point locations for various embodiments of the present invention. On the apparatus 1301, the intermediate link 244*x* and the foot supporting link 230*x* rotate about a common pivot axis 1311 relative to the frame 210*x*. On the apparatus 1302, the intermediate link 244*y* rotates about a pivot axis 1324 relative to the frame 210*y*, and the foot supporting link 230*y* rotates about a separate pivot axis 1323 relative to the frame 210*y* (as on the embodiment 200 shown in FIG. 9).

On the apparatus 1303, the foot supporting link 230*z* rotates about a separate pivot axis 1333 relative to the frame 210*z*, and the intermediate link 244*z* rotates about a pivot axis 1334 relative to the frame 210*z*. A connector link 1336 also rotates about the pivot axis 1334 relative to the frame 210*z*. The lower end of the hand connecting link 250*z* is rotatably connected to a first radially displaced portion of the connector link 1336. The forward end of the seat connecting link 260*z* is rotatably connected to a second radially displaced portion of the connector link 1336. Another link 1338 is rotatably interconnected between the foot supporting link 230*z* and the same second portion of the connector link 1336.

While preferred embodiments of the present invention have been illustrated in detail, it is apparent that modifications and adaptation of preferred embodiments will occur to those skilled in the art. For example, while the invention is illustrated in the preferred embodiment of a rider-type exercise machine, it may be embodied in a machine in which a user does not "ride" the machine. Examples of such machines are stair climbers, treadmills and bicycle exercise machines. Resistance other than the user's body weight can be provided according to numerous methods known to the art of exercise machines. Accordingly, the scope of the present invention is to be limited only to the extent of the following claims.

What it claimed is:

1. An exercise device, comprising:

a frame;

a seat connected to the frame for movement through a range of orientations relative to an underlying floor surface; and a handlebar connected to the frame, wherein the handlebar includes a first segment and a second segment, and both the first segment and the second segment are linked to move together in an arc about a first axis, and at least a portion of the second segment is movable in an arc about a second axis relative to the first segment, and the second axis extends perpendicular to the first axis, and the first axis is movable through a range of positions relative to the floor surface.

2. An exercise device comprising:

a frame;

a seat connected to the frame for movement through a range of orientations relative to an underlying floor surface; and a handlebar connected to the frame, wherein the handlebar includes a first segment and a second segment, and both the first segment and the second segment are linked to move together in an arc about a first axis, and at least a portion of the second segment is movable in an arc about a second axis relative to the first segment, and the second axis extends perpendicular to the first axis, and the first axis extends parallel to the floor surface, and the first axis is movable through a range of positions relative to the floor surface.

3. The exercise device of claim 2, wherein the second axis is movable through a range of orientations relative to the floor surface, including perpendicular to the floor surface.

4. The exercise device of claim 3, wherein the first segment is an elongate member, and the second segment is an L-shaped member having (a) a first section connected to the first segment and extending generally parallel thereto, and (b) a second section sized and configured for grasping and extending generally perpendicular to the first section.

5. The exercise device of claim 2, wherein the first segment is an elongate member, and the second segment is an L-shaped member having (a) a first section connected to the first segment and extending generally parallel thereto, and (b) a second section sized and configured for grasping and extending generally perpendicular to the first section.

6. The exercise device of claim 1, wherein the first segment is an elongate member, and the second segment is an L-shaped member having (a) a first section connected to the first segment and extending generally parallel thereto, and (b) a second section sized and configured for grasping and extending generally perpendicular to the first section.

7. The exercise device of claim 6, wherein the second axis is movable through a range of orientations relative to the floor surface, including perpendicular to the floor surface.

8. The exercise device of claim 1, wherein the second axis is movable through a range of orientations relative to the floor surface, including perpendicular to the floor surface.

9. An exercise device, comprising:

a frame;

a seat connected to the frame for movement through a range of orientations relative to an underlying floor surface;

a handlebar assembly connected to the frame, wherein the handlebar assembly includes a first segment and left and right second segments, and the first segment and the second segments are linked to move together in an arc about a first axis, and each of the second segments is movable in an arc about a respective second axis relative to the first segment, and each said second axis extends perpendicular to the first axis; and a resistance device interconnected between the second segments.

10. An exercise device, comprising:

a frame;

a seat connected to the frame for movement through a range of orientations relative to an underlying floor surface;

a handlebar assembly connected to the frame, wherein the handlebar assembly includes a first segment and left and right second segments, and the first segment and the second segments are linked to move together in an arc about a first axis, and each of the second segments is movable in an arc about a respective second axis relative to the first segment, and each said second axis extends perpendicular to the first axis; and a stop disposed between the second segments to prevent contact therebetween.

11. The exercise device of claim 10, further comprising a resistance device interconnected between the second segments.

* * * * *